US009427986B2

(12) United States Patent
Furukawa

(10) Patent No.: US 9,427,986 B2
(45) Date of Patent: Aug. 30, 2016

(54) PRINT MEDIUM-CONVEYING DEVICE AND INKJET PRINTING DEVICE

(71) Applicant: FUJIFILM Corporation, Tokyo (JP)

(72) Inventor: Koji Furukawa, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/626,290

(22) Filed: Feb. 19, 2015

(65) Prior Publication Data

US 2015/0158315 A1 Jun. 11, 2015

Related U.S. Application Data

(63) Continuation of application No. PCT/JP2013/071976, filed on Aug. 15, 2013.

(30) Foreign Application Priority Data

Aug. 22, 2012 (JP) ..... 2012-183391

(51) Int. Cl.
*B41J 2/01* (2006.01)
*B41J 13/00* (2006.01)
(Continued)

(52) U.S. Cl.
CPC ..... *B41J 13/009* (2013.01); *B41J 13/223* (2013.01); *B41J 13/226* (2013.01); *B65H 5/12* (2013.01); *B65H 5/36* (2013.01); *B65H 2301/5124* (2013.01); *B65H 2301/51256* (2013.01); *B65H 2406/351* (2013.01); *B65H 2801/21* (2013.01)

(58) Field of Classification Search
CPC ..... B41J 13/0009
USPC ..... 347/23, 104, 16, 101; 101/232
See application file for complete search history.

(56) References Cited

U.S. PATENT DOCUMENTS 5,816,155 A * 10/1998 Stephan ..... B41F 25/00 101/232
6,254,081 B1 7/2001 Rasmussen et al.
(Continued)

FOREIGN PATENT DOCUMENTS

DE 10019700 A1 6/2001
EP 0725025 A2 8/1996
(Continued)

OTHER PUBLICATIONS

International Search Report; PCT/JP2013/071976; Oct. 1, 2013.
(Continued)

*Primary Examiner* — Lam Nguyen
(74) *Attorney, Agent, or Firm* — Studebaker & Brackett PC

(57) ABSTRACT

There is provided a print medium-conveying device and an inkjet printing device that can convey a print medium without causing wrinkles, float and damage. In an embodiment, the front surface of paper passed to an image recording drum is pressed by a pressure roller, and is made to contact the peripheral surface of the image recording drum. The front surface of paper is sucked by a suction unit in a position immediately before it enters between the image recording drum and the pressure roller, and back tension is given. The back tension giving is turned on/off according to the thickness of the paper, and the back tension giving is turned off for paper whose thickness is equal to or greater than a threshold. It is possible to prevent paper with stiffness from strongly contacting an adsorption holding surface of the suction unit and the front surface from being damaged.

17 Claims, 21 Drawing Sheets

EXAMPLE 1:
THICKNESS OF PAPER AND OCCURRENCE STATUS OF FLOAT/WRINKLE AND DAMAGE (GLOSS PAPER)

| THICKNESS OF PAPER (BASIS WEIGHT) | | 0.09mm (104.7g/m²) | 0.11mm (127.9g/m²) | 0.13mm (157.0g/m²) |
|---|---|---|---|---|
| FLOAT/ WRINKLE | BT - ON | A | A | A |
| | BT - OFF | C | C | B |
| DAMAGE | BT - ON | A | B | C |
| | BT - OFF | A | A | B |

A: NOT OCCUR
B: OCCUR WITHIN TOLERANCE
C: OUT OF TOLERANCE

(51) Int. Cl.

| | |
|---|---|
| ***B65H 5/36*** | (2006.01) |
| ***B41J 13/22*** | (2006.01) |
| ***B65H 5/12*** | (2006.01) |

(56) References Cited

U.S. PATENT DOCUMENTS

| | | | | |
|---|---|---|---|---|
| 7,517,045 | B2 * | 4/2009 | Inoue | B41J 3/44 347/23 |
| 2003/0189286 | A1 | 10/2003 | Shimizu et al. | |
| 2009/0231377 | A1 | 9/2009 | Kachi | |
| 2011/0234730 | A1 | 9/2011 | Fukui et al. | |
| 2012/0224012 | A1 * | 9/2012 | Inoue | B41F 21/00 347/104 |

FOREIGN PATENT DOCUMENTS

| | | | |
|---|---|---|---|
| EP | 2123461 | A1 | 11/2009 |
| EP | 2505369 | A1 | 10/2012 |
| JP | 2003-291304 | A | 10/2003 |
| JP | 2009-220954 | A | 10/2009 |
| JP | 2010-094953 | A | 4/2010 |
| JP | 2012-184044 | A | 9/2012 |

OTHER PUBLICATIONS

The extended European search report issued by the European Patent Office on Apr. 20, 2016, which corresponds to European Patent Application No. 13830573.5-1701 and is related to U.S. Appl. No. 14/626,290.

* cited by examiner

FIG.20

EXAMPLE 1:
THICKNESS OF PAPER AND OCCURRENCE STATUS OF FLOAT/WRINKLE AND DAMAGE (GLOSS PAPER)

| THICKNESS OF PAPER (BASIS WEIGHT) | | 0.09mm (104.7g/m$^2$) | 0.11mm (127.9g/m$^2$) | 0.13mm (157.0g/m$^2$) |
|---|---|---|---|---|
| FLOAT/ WRINKLE | BT - ON | A | A | A |
| | BT - OFF | C | C | B |
| DAMAGE | BT - ON | A | B | C |
| | BT - OFF | A | A | B |

A: NOT OCCUR
B: OCCUR WITHIN TOLERANCE
C: OUT OF TOLERANCE

FIG.21

EXAMPLE 2:
THICKNESS OF PAPER AND OCCURRENCE STATUS OF FLOAT/WRINKLE AND DAMAGE (MAT PAPER)

| THICKNESS OF PAPER (BASIS WEIGHT) | | 0.11mm (104.7g/m$^2$) | 0.13mm (127.9g/m$^2$) | 0.16mm (157.0g/m$^2$) |
|---|---|---|---|---|
| FLOAT/ WRINKLE | BT - ON | A | A | A |
| | BT - OFF | C | B | A |
| DAMAGE | BT - ON | A | C | C |
| | BT - OFF | A | A | B |

A: NOT OCCUR
B: OCCUR WITHIN TOLERANCE
C: OUT OF TOLERANCE

FIG.22

EXAMPLE 3:
THICKNESS OF PAPER AND OCCURRENCE STATUS
OF FLOAT/WRINKLE AND DAMAGE (HIGH-QUALITY PAPER)

| THICKNESS OF PAPER (BASIS WEIGHT) | | 0.11mm (81.4g/m$^2$) | 0.13mm (104.7g/m$^2$) | 0.15mm (127.9g/m$^2$) | 0.18mm (157.0g/m$^2$) |
|---|---|---|---|---|---|
| FLOAT/ WRINKLE | BT - ON | A | A | A | A |
| | BT - OFF | C | B | A | A |
| DAMAGE | BT - ON | A | C | C | C |
| | BT - OFF | A | A | A | B |

A: NOT OCCUR
B: OCCUR WITHIN TOLERANCE
C: OUT OF TOLERANCE

FIG.23

EXAMPLE 4:
THICKNESS OF PAPER AND OCCURRENCE STATUS
OF FLOAT/WRINKLE AND DAMAGE (PAPERBOARD)

| THICKNESS OF PAPER (BASIS WEIGHT) | | 0.20mm (210g/m$^2$) | 0.26mm (260g/m$^2$) | 0.32mm (310g/m$^2$) |
|---|---|---|---|---|
| FLOAT/ WRINKLE | BT - ON | A | A | A |
| | BT - OFF | A | A | A |
| DAMAGE | BT - ON | C | C | C |
| | BT - OFF | B | B | B |

A: NOT OCCUR
B: OCCUR WITHIN TOLERANCE
C: OUT OF TOLERANCE

PRINT MEDIUM-CONVEYING DEVICE AND INKJET PRINTING DEVICE

CROSS-REFERENCE TO RELATED APPLICATIONS

This application is a Continuation of PCT International Application No. PCT/JP2013/071976 filed on Aug. 15, 2013, which claims priority under 35 U.S.C. §119(a) to Japanese Patent Application No. 2012-183391 filed on Aug. 22, 2012. Each of the above application(s) is hereby expressly incorporated by reference, in its entirety, into the present application.

BACKGROUND OF THE INVENTION

1. Field of the Invention

The present invention relates to a print medium-conveying device and an inkjet printing device, and particularly relates to a technique of conveying a sheet-like print medium such as a printing paper by a drum.

2. Description of the Related Art

There is known a drum conveying system as a conveying system of a print medium in an inkjet printing device. In the drum conveying system, the print medium is conveyed by winding the print medium around the outer peripheral surface of a drum and rotating the drum.

PTL 1 (Japanese Patent Application No. 2009-220954) describes an inkjet printing device that adopts the drum conveying system. In this inkjet printing device, to prevent float and wrinkles from being caused in a print medium wound around a drum, a configuration is provided in which, when the print medium is transferred from a drum to a drum, it is transferred while giving back tension to the print medium. Specifically, when the print medium is conveyed by a drum in the previous stage, by disposing a guide plate along the conveyance path of the print medium and sucking the back surface of the print medium by the guide plate, the back tension is given to the print medium.

SUMMARY OF THE INVENTION

By the way, in a place in which the flatness of a print medium is requested like a printing part, since the print medium is made to contact a drum, a pressure roller is installed on the outer peripheral surface of the drum. The pressure roller presses the front surface of the print medium wound on the outer peripheral surface of the drum and makes the print medium contact the drum. In a case where such a pressure roller is installed, the print medium is made to contact the drum in order from the front edge. At this time, if there is no support for the print medium, there is a problem that the print medium loosens and wrinkles are caused at the time of pressure.

In the case of PTL 1, while a print medium is guided to a guide plate, it is possible to lead the print medium to between a drum and a pressure roller without deflection by the effect of back tension. However, when the print medium passes through the conveyance guide, there is a problem that the back tension is not given to the print medium, the print medium loosens in the rear edge part of the print medium and wrinkles are caused at the time of pressure.

Moreover, in PTL 1, since a configuration is provided in which the back surface of a print medium is made to contact a guide plate by suction and back tension is given to the print medium, if an image is already recorded on the back surface side (for example, at the time of duplex printing, and so on), there is a disadvantage that the image is damaged.

The present invention is made in view of such circumferences, and it is an object to provide a print medium-conveying device and inkjet printing device that can convey a print medium without causing wrinkles, float and damage.

Means for Solving the Problem is as Follows

The first mode is a print medium-conveying device including: a drum that conveys a print medium by winding a sheet-like print medium around an outer peripheral surface and performing rotation; a pressure roller that presses a front surface of the print medium wound around the outer peripheral surface of the drum and makes a back surface of the print medium contact the outer peripheral surface of the drum; a back tension giving device having an adsorption holding surface to which the front surface of the print medium is adsorbed and held, which adsorbs and holds the front surface of the print medium to the adsorption holding surface in a position immediately before entry between the drum and the pressure roller, and gives back tension to the print medium; a print medium information acquisition device which acquires information of the print medium; and a control device which controls ON/OFF of adsorption of the print medium by the back tension giving device, based on the information of the print medium acquired by the print medium information acquisition device.

According to this mode, the front surface of the print medium is adsorbed and held to the adsorption holding surface in the position immediately before entry between the drum and the pressure roller. By this means, it is possible to wind the print medium around the drum while giving the back tension and make the print medium contact the outer peripheral surface of the drum without causing float and wrinkles. Moreover, since the front surface side of the print medium is adsorbed and held to the adsorption holding surface and the back tension is given, even in a case where an image is recorded on the back surface side, the image is never damaged. Meanwhile, regarding a print medium having so-called stiffness, it is possible to wind it around the outer peripheral surface of the drum and convey it without causing float and wrinkles even if the back tension is not given. By contrast, when the back tension is given to the print medium with strong stiffness, the front surface of the print medium is pressed against the adsorption holding surface, and there is a danger that the front surface is damaged. Therefore, in this mode, by acquiring information of the print medium and turning on/off the back tension giving according to the print medium (turning on/off adsorption of the print medium), it is designed to wind the print medium around the outer peripheral surface of the drum without causing wrinkles, float and damage. As mentioned above, the necessity/unnecessity of back tension giving can be determined from the degree of stiffness of the print medium. The degree of stiffness of the print medium is mainly based on the thickness of the print medium. Therefore, the necessity/unnecessity of back tension giving can be determined by acquiring at least information of the thickness. Moreover, the frequency at which it is damaged greatly depends on the property of the front surface of the print medium. That is, in a case where the print medium is a printing paper, the damage is likely to be remarkable in the gloss paper of high smoothness (glossiness) and is less likely to be remarkable in the mat paper and the high-quality paper. Therefore, by determining the necessity/unnecessity of back tension giving in consideration of the smoothness of the print medium in addition, it is possible to suppress the occurrence of float and wrinkles, suppress the occurrence of damage, and wind the print medium around the outer peripheral surface of the drum and convey it.

The second mode is a mode in which, in the print medium-conveying device according to the above-mentioned first mode, the back tension giving device performs suction from a suction hole formed on the adsorption holding surface and adsorbs and holds the front surface of the print medium to the adsorption holding surface, and the control device controls ON/OFF of the suction from the suction hole and controls ON/OFF of the adsorption of the print medium by the back tension giving device.

According to this mode, by performing suction from the suction hole formed on the adsorption holding surface, the front surface of the print medium is adsorbed and held to the adsorption holding surface, and the back tension is given to the print medium. The control device controls ON/OFF of the suction from the suction hole and turns on/off back tension giving (turns on/off adsorption of the print medium). Since the suction is merely turned on/off, it is possible to control ON/OFF of the back tension giving easily.

The third mode is a mode in which, in the print medium-conveying device according to the above-mentioned first mode, the back tension giving device performs suction from a suction hole formed on the adsorption holding surface and adsorbs and holds the front surface of the print medium to the adsorption holding surface while preventing the print medium from contacting the adsorption holding surface by performing ventilation from the suction hole, and the control device controls the suction/ventilation from the suction hole and controls ON/OFF of the adsorption of the print medium by the back tension giving device.

According to this mode, the back tension giving device adsorbs and holds the front surface of the print medium to the adsorption holding surface by performing suction from the suction hole formed on the adsorption holding surface, and gives the back tension to the print medium (back tension ON). Moreover, the back tension giving device prevents the front surface of the print medium from contacting the adsorption holding surface by performing ventilation from the suction hole (back tension OFF). The control device controls the suction/ventilation from the suction hole and turns on/off the back tension giving (turns on/off adsorption of the print medium). Since the switching of suction and ventilation is merely performed, it is possible to control ON/OFF of the back tension giving easily. Moreover, in a case where the back tension giving is turned off, instead of merely stopping suction, ventilation from the suction hole is performed, and therefore it is possible to reliably prevent the front surface of the print medium from contacting the adsorption holding surface.

The fourth mode is a mode in which, in the print medium-conveying device according to the above-mentioned first mode, the back tension giving device is installed so as to be movable between a first position in which the front surface of the print medium immediately before entering between the drum and the pressure roller can be adsorbed and held to the adsorption holding surface and a second position in which the to front surface of the print medium immediately before entering between the drum and the pressure roller cannot be adsorbed and held to the adsorption holding surface, and the control device controls movement of the back tension giving device and controls ON/OFF of the adsorption of the print medium by the back tension giving device.

According to this mode, the back tension giving device is installed so as to be movable between the first position (position in which the front surface of the print medium immediately before entering between the drum and the pressure roller can be adsorbed and held to the adsorption holding surface) and the second position (position in which the front surface of the print medium immediately before entering between the drum and the pressure roller cannot be adsorbed and held to the adsorption holding surface). The control device controls the movement of the back tension giving device and turns on/off the back tension giving (turns on/off adsorption of the print medium). Since the position of the back tension giving device is merely changed, it is possible to control ON/OFF of the back tension giving easily. Moreover, in a case where the back tension giving is turned off, instead of merely stopping suction, evacuation is performed such that the adsorption holding surface does not contact the print medium, and therefore it is possible to reliably prevent the front surface of the print medium from contacting the adsorption holding surface.

The fifth mode is a mode in which, in the print medium-conveying device according to the above-mentioned fourth mode, the back tension giving device performs suction from a suction hole formed on the adsorption holding surface and adsorbs and holds the front surface of the print medium to the adsorption holding surface, and the control device controls ON/OFF of the suction from the suction hole, controls movement of the back tension giving device and controls ON/OFF of the adsorption of the print medium by the back tension giving device.

According to this mode, the back tension giving device adsorbs and holds the front surface of the print medium to the adsorption holding surface by performing suction from the suction hole formed on the adsorption holding surface, and gives back tension to the print medium (back tension ON). In a case where the back tension giving is turned off (adsorption of the print medium is turned off), the suction from the suction hole is turned off and the back tension giving device is moved to the second position (position in which the front surface of the print medium immediately before entering between the drum and the pressure roller cannot be adsorbed and held to the adsorption holding surface). By this means, it is possible to prevent the print medium from contacting the adsorption holding surface more reliably.

The sixth mode is a mode in which, in the print medium-conveying device according to the above-mentioned fourth mode, the back tension giving device performs suction from a suction hole formed on the adsorption holding surface and adsorbs and holds the front surface of the print medium to the adsorption holding surface while preventing the print medium from contacting the adsorption holding surface by performing ventilation from the suction hole, and the control device controls the suction/ventilation from the suction hole, controls movement of the back tension giving device and controls ON/OFF of the adsorption of the print medium by the back tension giving device.

According to this mode, the back tension giving device adsorbs and holds the front surface of the print medium to the adsorption holding surface by performing suction from the suction hole formed on the adsorption holding surface, and gives back tension to the print medium (back tension ON). In a case where the back tension giving is turned off (adsorption of the print medium is turned off), the ventilation from the suction hole is performed and the back tension giving device is moved to the second position (position in which the front surface of the print medium immediately before entering between the drum and the pressure roller cannot be adsorbed and held to the adsorption holding surface). By this means, it is possible to prevent the print medium from contacting the adsorption holding surface more reliably.

The seventh mode is a mode in which, the print medium-conveying device according to any one of the above-mentioned first to sixth modes, the print medium is a paper and the information of the print medium acquired by the print medium information acquisition device is thickness of the print medium, and the control device compares the thickness of the print medium acquired by the print medium information acquisition device and a threshold set beforehand, turns on the adsorption of the print medium by the back tension giving device when the thickness of the print medium acquired by the print medium information acquisition device is less than the threshold, and turns off the adsorption of the print medium by the back tension giving device when the thickness is equal to or greater than the threshold.

According to this mode, in a case where the print medium is a paper, the back tension giving is turned on/off on the basis of the thickness of the paper. As mentioned above, the necessity/unnecessity of back tension giving can be determined by the degree of stiffness of the print medium, and the degree of stiffness of the print medium is mainly based on the thickness of the print medium. Therefore, the necessity/unnecessity of back tension giving can be appropriately determined by acquiring at least information of the thickness.

The eighth mode is a mode in which, in the print medium-conveying device according to the above-mentioned seventh mode, the threshold is 0.13 mm.

According to this mode, in a case where the print medium is a paper (for example, a printing paper), the back tension giving is turned on when the thickness is less than 0.13 mm, and the back tension giving is turned off when it is equal to or greater than 0.13 mm. By this means, it is possible to wind the paper as the print medium around the outer peripheral surface of the drum and transport it without causing float, wrinkles and damage, and so on.

The ninth mode is a mode in which, in the print medium-conveying device according to any one of the above-mentioned first to sixth modes, the print medium is a paper and the information of the print medium acquired by the print medium information acquisition device is thickness and paper type of the print medium, and the control device compares the thickness of the print medium acquired by the print medium information acquisition device and a threshold set beforehand for each paper type, turns on the adsorption of the print medium by the back tension giving device when the thickness of the print medium acquired by the print medium information acquisition device is less than the threshold, and turns off the adsorption of the print medium by the back tension giving device when the thickness is equal to or greater than the threshold.

According to this mode, in a case where the print medium is a paper (for example, a printing paper), the necessity/unnecessity of back tension giving is determined on the basis of the thickness and paper type of the paper. Since damage is less likely to be remarkable depending on the paper type (the damage is likely to be remarkable in the gloss paper with high smoothness and is less likely to be remarkable in the mat paper and the high-quality paper), by determining the necessity/unnecessity of back tension giving in consideration of the paper type in addition, it is possible to prevent the occurrence of float, wrinkles and damage more effectively.

The tenth mode is a mode in which, in the print medium-conveying device according to any one of the above-mentioned first to ninth modes, the drum further includes an adsorption holding device which adsorbs and holds a back surface of the print medium wound on the outer peripheral surface.

According to this mode, the adsorption holding device is installed in the drum. By this means, it is possible to further improve the adhesion of the print medium.

The eleventh mode is an inkjet printing device including: the print medium-conveying device according to any one of the above-mentioned first to tenth modes; and an inkjet head that ejects an ink droplet to a front surface of the print medium conveyed by the drum.

According to this mode, an image is recorded by ejecting an ink droplet to the front surface of the print medium conveyed by the print medium-conveying device according to any one of the above-mentioned first to tenth modes. Since the print medium-conveying device according to the above-mentioned first to tenth modes can convey the print medium without causing float, wrinkles and damage, it is possible to record an image of high grade.

According to the present invention, it is possible to convey a print medium without causing wrinkles, float and damage. By this means, it is possible to record an image of high quality.

BRIEF DESCRIPTION OF THE DRAWINGS

FIG. 20 is a table (Example 1) illustrating the occurrence status of float/wrinkles and damage of a gloss paper.

FIG. 21 is a table (Example 2) illustrating the occurrence status of float/wrinkles and damage of a mat paper.

FIG. 22 is a table (Example 3) illustrating the occurrence status of float/wrinkles and damage of a high-quality paper.

FIG. 23 is a table (Example 4) illustrating the occurrence status of float/wrinkles and damage of a paperboard.

DETAILED DESCRIPTION OF THE EMBODIMENTS

In the following, preferable embodiments of the present invention are described in detail according to the accompanying drawings.

<<Entire Configuration of Inkjet Printing Device>>

First, the entire configuration of an inkjet printing device is described.

Figure 1:
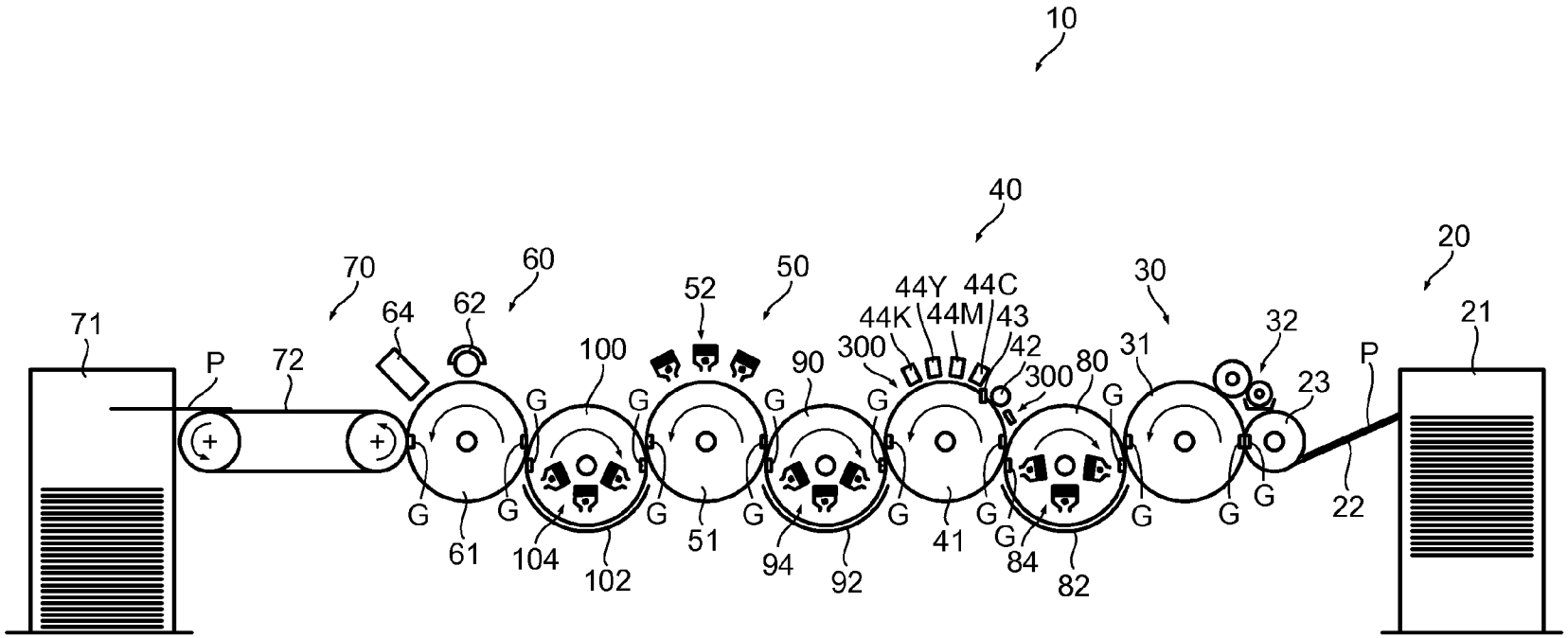
FIG. 1 is a whole configuration diagram illustrating an embodiment of an inkjet printing device according to the present invention.

FIG. 1 is the whole configuration diagram illustrating an embodiment of an inkjet printing device according to the present invention.

This inkjet printing device 10 is an apparatus that performs printing in sheet paper (sheet-like print medium) P by the use of aqueous ink (ink dissolving or dispersing a coloring material such as dyestuff and pigment in water and water-soluble solvent) in an inkjet system, and is configured including a paper feed unit 20 that feeds paper P, a process liquid application unit 30 that applies a process liquid to the front surface (printing surface) of paper P, an image recording unit 40 that deposits the ink drop of each color of cyanogen (C), magenta (M), yellow (Y) and black (K) to the printing surface of paper P with an inkjet head to draw a color image, an ink drying unit 50 that dries the ink drop deposited to paper P, a fixing unit 60 that fixes an image recorded in paper P, and a collection unit 70 that collects paper P.

Conveying drums (drums) 31, 41, 51 and 61 are installed in respective units of the process liquid application unit 30, the image recording unit 40, the ink drying unit 50 and the fixing unit 60 as a conveying device of paper P. Paper P is conveyed to respective units of the process liquid application unit 30, the image recording unit 40, the ink drying unit 50 and the fixing unit 60 by these conveying drums 31, 41, 51 and 61.

Respective conveying drums 31, 41, 51 and 61 are formed in a cylindrical manner and formed corresponding to the paper width. Respective conveying drums 31, 41, 51 and 61 are driven by an unillustrated motor and rotated (rotated in a counterclockwise direction in FIG. 1). Paper P is wound around the outer peripheral surfaces of respective conveying drums 31, 41, 51 and 61 and conveyed.

A gripper is installed in the peripheral surfaces of respective conveying drums 31, 41, 51 and 61. Paper P is conveyed while the front edge part thereof is held by this gripper. In this example, gripper G is installed in two positions on the peripheral surfaces of respective conveying drums 31, 41, 51 and 61. Gripper G is installed at intervals of 180°. By this means, two papers can be conveyed by one rotation.

Moreover, an adsorption holding mechanism (an adsorption holding device) that adsorbs and holds paper P wound around the outer peripheral surface is installed in respective conveying drums 31, 41, 51 and 61. In this example, paper P is adsorbed and held on the outer peripheral surface by the use of air pressure (negative pressure). Therefore, many suction holes are formed in the outer peripheral surfaces of respective conveying drums 31, 41, 51 and 61. Paper P is adsorbed and held on the outer peripheral surfaces of respective conveying drums 31, 41, 51 and 61 while the back surface is sucked from this suction hole. The adsorption holding mechanism can adopt a system using static electricity (so-called electrostatic adsorption system).

Transfer cylinders (a rotation conveyance device) 80, 90 and 100 are disposed between the process liquid application unit 30 and the image recording unit 40, between the image recording unit 40 and the ink drying unit 50, and between the ink drying unit 50 and the fixing unit 60, respectively. Paper P is conveyed between respective units by these transfer cylinders 80, 90 and 100.

Respective transfer cylinders 80, 90 and 100 are configured with a cylindrical frame body and formed corresponding to the paper width. Respective transfer cylinders 80, 90 and 100 are driven by an unillustrated motor and rotated (rotated in a clockwise direction in FIG. 1).

Gripper G is installed in the peripheral surfaces of respective transfer cylinders 80, 90 and 100. Paper P is conveyed while the front edge part thereof is held by this gripper G. In this example, gripper G is installed in two positions on the outer peripheral parts of respective transfer cylinders 80, 90 and 100. Gripper G is installed at intervals of 180°. By this means, two papers can be conveyed by one rotation.

Arc-shaped guide plates 82, 92 and 102 along the conveyance path of paper P are arranged in the lower parts of respective transfer cylinders 80, 90 and 100. Paper P conveyed by the transfer cylinders 80, 90 and 100 is conveyed while the back surface (surface on the opposite side of the printing surface) is guided by these guide plates 82, 92 and 102.

Moreover, in the inside of respective transfer cylinders 80, 90 and 100, driers 84, 94 and 104 that blows hot air to paper P conveyed by the transfer cylinder 80 are installed (in this example, three items are installed along the conveyance path of paper P). For paper P conveyed by respective transfer cylinders 80, 90 and 100, the hot air blown from the driers 84, 94 and 104 in the conveyance process is blown to the printing surface. By this means, it is possible to perform drying processing on paper P in the conveyance process by respective transfer cylinders 80, 90 and 100.

Here, the driers 84, 94 and 104 can adopt a configuration to emit heat from an infrared heater or the like and perform heating (so-called heating by radiation), in place of a configuration to perform heating by blowing hot air.

Paper P fed from the paper feed unit 20 is conveyed in order from the conveying drum 31, the transfer cylinder 80, the conveying drum 41, the transfer cylinder 90, the conveying drum 51, the transfer cylinder 100 and the conveying drum 61, and is collected in the collection unit 70 at last. Necessary processing is applied to paper P until the time it is collected in the collection unit 70 after this paper feed unit 20, and an image is recorded on the printing surface.

In the following, the configuration of each unit of the inkjet printing device 10 of the present embodiment is described in detail.

<Paper Feed Unit>

The paper feed unit 20 periodically feeds sheet paper P one by one. This paper feed unit 20 is chiefly configured with a paper feed apparatus 21, a paper feed tray 22 and a transfer cylinder 23.

The paper feed apparatus 21 feeds paper P stacked in an unillustrated magazine to the paper feed tray 22 one by one in order from the upper side.

The paper feed tray 22 sends paper P fed from the paper feed apparatus 21 to the transfer cylinder 23.

The transfer cylinder 23 receives paper P sent from the paper feed tray 22, and rotates and passes it to the conveying drum 31 of the process liquid application unit 30.

Paper P is not especially limited, but it is possible to use a general-purpose printing paper (paper mainly including cellulose, such as a so-called high-quality paper, coat paper and art paper) used in a general offset printing, and so on. In addition, in the coat paper and the art paper, it is also possible to use both gloss paper and mat paper of different glossiness.

As for the general-purpose printing paper, when printing is performed in an inkjet printing system, bleed or the like is caused and the image grade is deteriorated. Therefore, to prevent such a trouble, in the inkjet printing device 10 of this embodiment, a process liquid is applied to the printing surface of paper P in the following process liquid application unit 30.

<Process Liquid Application Unit>

The process liquid application unit 30 applies a process liquid to the printing surface of paper P. This process liquid application unit 30 is mainly configured with a conveying drum (hereinafter referred to as "process liquid application drum") 31 that conveys paper P, and an application apparatus 32 that applies a process liquid to the printing surface of paper P conveyed by the process liquid application drum 31.

The process liquid application drum 31 receives paper P from the transfer cylinder 23 of the paper feed unit 20 (receives it while holding the front edge of paper P by gripper G), and rotates and conveys paper P along a conveyance path.

The application apparatus 32 performs roller application of a process liquid to the printing surface of paper P conveyed by the process liquid application drum 31. That is, an application roller whose peripheral surface is covered with a process liquid is pressed and made to contact the printing surface of paper P conveyed by the process liquid application drum 31 to apply the process liquid to the printing surface of paper P. The process liquid is applied at constant thickness.

The process liquid applied in the application apparatus 32 is mainly formed with liquid including coagulant that agglutinates the components of ink composition.

As the coagulant, it may be a compound in which the pH of the ink composition can be changed, polyvalent metallic salt or polyallylamine.

As a compound that may decrease the pH, acid substances of high water solubility (derivative of phosphoric acid, oxalic acid, malonic acid, citric acid or a compound of these, or a salt of these) are suitably given. One kind of the acid substance may be used alone, or two kinds or more may be used together. By this means, it is possible to improve the aggregability and fix the entire ink.

Moreover, it is preferable that the pH (25° C.) of an ink composition is 8.0 or more and the pH (25° C.) of a process liquid is within a range of 0.5 to 4. By this means, it is possible to achieve the speed-up of image density, resolution and inkjet printing.

Moreover, the process liquid can contain additives. For example, it can contain known additives such as a drying inhibitor (wetting agent), a fading inhibitor, an emulsion stabilizer, a penetration enhancer, an ultraviolet absorber, a preservative, an anti-mold agent, a pH regulator, a surface tension regulator, an antifoaming agent, a viscosity regulator, a dispersing agent, a dispersion stabilizer, an anti-rust agent and a chelating agent.

By applying such a process liquid to the printing surface of paper P beforehand and performing printing, it is possible to prevent the occurrence of feathering and bleeding, and so on, and perform printing of high grade even if a general printing paper is used.

In the process liquid application unit 30 of the above-mentioned configuration, paper P is held by the process liquid application drum 31 and conveyed through the conveyance path. Further, a process liquid is applied to the printing surface by the application apparatus 32 in the conveyance process.

Paper P whose printing surface is covered with the process liquid is subsequently passed from the process liquid application drum 31 to the transfer cylinder 80 in a prescribed position. Further, it is conveyed in the conveyance path by the transfer cylinder 80 and passed to the conveying drum 41 of the image recording unit 40.

Here, as mentioned above, the drier 84 is installed inside the transfer cylinder 80, and hot air is blown to the guide plate 82. In paper P, the heat air is blown to the printing surface in a process in which it is conveyed from the process liquid application unit 30 to the image recording unit 40 by this transfer cylinder 80, and the process liquid applied to the printing surface is dried (the solvent component in the process liquid is evaporated and removed).

<Image Recording Unit>

The image recording unit 40 deposits the ink drop of each color of C, M, Y and K to the printing surface of paper P and draws a color image on the printing surface of paper P. This image recording unit 40 is mainly configured with a conveying drum (hereinafter referred to as "image recording drum") 41 that conveys paper P, a pressure roller 42 that presses the printing surface of paper P and makes the back surface of paper P contact the peripheral surface of the image recording drum 41, a paper float detection sensor 43 that detects the float of paper P, inkjet heads 44C, 44M, 44Y and 44K that ejects the ink drop of each color of C, M, Y and K to paper P and draws an image, and a back tension giving apparatus (a back tension giving device) 300 that sucks the front surface (printing surface) of paper P in a position previous to the pressure roller 42 and gives back tension to paper P.

The image recording drum 41 receives paper P from the transfer cylinder 80 (receives it while holding the front edge of paper P by gripper G), and rotates and conveys paper P along the conveyance path.

The pressure roller 42 is configured with a rubber roller (roller in which at least the outer peripheral part is configured with rubber (elastic body)) having almost the same width as the width of the image recording drum 41, and is disposed near a paper reception position (position in which paper P is received from the transfer cylinder 80). As for paper P passed from the transfer cylinder 80 to the image recording drum 41, when the front surface is pressed by this pressure roller 42, the back surface is made to contact the outer peripheral surface of the image recording drum 41.

The paper float detection sensor 43 detects the float of paper P having passed the pressure roller 42 (detects float equal to or greater than a constant level from the outer peripheral surface of the image recording drum 41). This paper float detection sensor 43 is configured with a laser projector 43A that projects a laser light, and a laser receiver 43B that receives the laser light.

The laser projector 43A projects a laser light, which is parallel to the shaft of the image recording drum 41 in one end to the other end of the image recording drum 41, to a position separated by predetermined height from the outer peripheral surface of the image recording drum 41 (position of the upper-limit height in tolerance of the float).

The laser receiver 43B is disposed facing the laser projector 43A across the running path of paper P by the image recording drum 41, and receives the laser light projected from the laser projector 43A.

When float equal to more than allowance is caused in paper P conveyed by the image recording drum 41, the laser light projected from the laser projector 43A is blocked by paper P. As a result of this, the light amount of laser light received in the laser receiver 43B decreases. The paper float detection sensor 43 detects the light amount of laser light received in this laser receiver 43B and detects the float of paper P. That is, the light amount of laser light received in the laser receiver 43B and a threshold are compared, and, in a case where it is equal to or less than the threshold, it is determined that the float (float equal to or greater than the allowance) is caused.

The rotation of the image recording drum 41 is stopped when the float equal to or greater than the allowance is detected, and the conveyance of paper P is stopped.

Here, the paper float detection sensor 43 is configured such that it is possible to adjust the height of the laser light projected from the laser projector 43A (height from the outer peripheral surface of the image recording drum 41). By this means, it is possible to arbitrarily set the tolerance of the float.

Four inkjet heads 44C, 44M, 44Y and 44K are placed in the subsequent stage of the paper float detection sensor 43 and disposed along the conveyance direction of paper P at regular intervals. These inkjet heads 44C, 44M, 44Y and 44K are configured with line heads corresponding to the paper width, and a nozzle surface is formed in the lower surface (surface facing the outer peripheral surface of the image recording drum 41). In the nozzle surface, a nozzle is disposed at regular pitches in a direction orthogonal to the conveyance direction of paper P (nozzle row). Respective inkjet heads 44C, 44M, 44Y and 44K eject an ink drop from this nozzle to the image recording drum 41.

Ink used in the inkjet printing device 10 of the present embodiment is aqueous ultraviolet-curable ink, and contains a water-soluble polymeric compound polymerized by pigment, polymer particle and active energy line. The aqueous ultraviolet-curable ink can be hardened by irradiating ultraviolet rays, and has a characteristic of excellent resistance and high film strength.

As for the pigment, a water-dispersible pigment in which at least part of the front surface is covered with a polymer dispersing agent is used.

As for the polymer dispersing agent, a polymer dispersing agent whose acid value is 25 to 1000 (KOHmg/g) is used. The stability of self-dispersibility becomes excellent, and the agglutination property at the time of contact of a process liquid becomes excellent.

As the polymer particle, a self-dispersibility polymer particle whose acid value is 20 to 50 (KOHmg/g) is used. The stability of self-dispersibility becomes excellent, and the agglutination property at the time of contact of a process liquid becomes excellent.

As the polymeric compound, a nonionic or cationic polymeric compound is preferable in that the reaction of coagulant, pigment and polymer particle is not disturbed, and it is preferable to use a polymeric compound whose solubility with respect to water is equal to or greater than 10 mass % (furthermore, equal to or greater than 15 mass %).

Moreover, ink contains an initiator that starts the polymerization of a polymeric compound by an active energy line. By arbitrary selection, the initiator can contain a compound that can start a polymerization reaction by an active energy line, and, for example, it is possible to use an initiator (for example, photoinitiator and so on) that generates active species (such as radical, acid and base) by radiation, light or electron beam. Here, the initiator can be contained in a process liquid, and, it only has to be contained in at least one of the ink and the process liquid.

Moreover, the ink contains water of 50 to 70 mass %. Moreover, the ink can contain an additive. For example, it can contain known additives such as a water-soluble organic solvent, a drying inhibitor (wetting agent), a fading inhibitor, an emulsion stabilizer, a penetration enhancer, an ultraviolet absorber, a preservative, an anti-mold agent, a pH regulator, a surface tension regulator, an antifoaming agent, a viscosity regulator, a dispersing agent, a dispersion stabilizer, an anti-rust agent and a chelating agent.

As for paper P conveyed by the image recording drum 41, by sucking the upper surface of paper P in a position immediately before bring pressed by the pressure roller 42 (position immediately before it enters between the image recording drum 41 and the pressure roller 42), the back tension giving apparatus 300 makes the upper surface of paper P contact an adsorption holding surface and gives back tension to paper P.

By giving the back tension to paper P immediately before being pressed by the pressure roller 42 in the back tension giving apparatus 300, it is possible to make paper P enter between the pressure roller 42 and the image recording drum 41 while extending a deformation (distortion) caused in paper P. Further, by pressing paper P by the pressure roller 42 while giving the back tension to paper P by the back tension giving apparatus 300, it is possible to make paper P contact the outer peripheral surface of the image recording drum 41 without causing float and wrinkles in paper P.

In the image recording unit 40 of the above-mentioned configuration, paper P is conveyed in the conveyance path by the image recording drum 41. Paper P passed from the transfer cylinder 80 to the image recording drum 41 is nipped by the pressure roller 42 while the back tension is given by the back tension giving apparatus 300, and is made to contact the outer peripheral surface of the image recording drum 41. Next, the existence/nonexistence of float is detected by the paper float detection sensor 43, and, afterward, the ink drop of each color of C, M, Y and K is deposited from each of the inkjet heads 44C, 44M, 44Y and 44K to the printing surface, and a color image is drawn on the printing surface.

Here, in a case where the float of paper P is detected, the conveyance is stopped. By this means, it is possible to prevent floating paper P from contacting the nozzle surfaces of the inkjet heads 44C, 44M, 44Y and 44K.

As mentioned above, aqueous ink is used as each color in the inkjet printing device 10 of this example. Even in a case where such aqueous ink is used, since a process liquid is applied to paper P as mentioned above, it is possible to perform printing of high grade even in a case where a general printing paper is used.

Paper P in which an image is drawn is passed to the transfer cylinder 90. Further, it is conveyed in the conveyance path by the transfer cylinder 90 and passed to the conveying drum 51 of the ink drying unit 50.

Here, as mentioned above, the drier 94 is installed inside the transfer cylinder 90, and hot air is blown to the guide plate 92. Ink drying processing is performed in the ink drying unit 50 in a subsequent stage, and the drying processing is applied to paper P even at the time of conveyance by this transfer cylinder 90.

Here, a conveying mechanism (print medium-conveying device) of paper P in the image recording unit 40 including the back tension giving apparatus 300 is described later in detail.

<Ink Drying Unit>

The ink drying unit 50 dries a liquid component remaining in paper P after image recording. This ink drying unit 50 is mainly configured with a conveying drum (hereinafter referred to as "ink drying drum") 51 that conveys paper P, and an ink drying apparatus 52 that applies drying processing to paper P conveyed by the ink drying drum 51.

The ink drying drum 51 receives paper P from the transfer cylinder 90 (receives it while holding the front edge of paper P by gripper G), and rotates and conveys paper P along the conveyance path.

The ink drying apparatus 52 is configured with, for example, a drier (configured with three driers arranged along the conveyance path of paper P in this example), and blows hot air (for example, 80° C.) to paper P conveyed by the ink drying drum 51.

In the ink drying unit 50 of the above-mentioned configuration, paper P is conveyed in the conveyance path by the ink drying drum 51. Further, the hot air is blown from the ink drying apparatus 52 to the printing surface in the conveyance process, and the ink given to the printing surface is dried (the solvent component is evaporated and removed).

Paper P having passed the ink drying apparatus 52 is subsequently passed from the ink drying drum 51 to the transfer cylinder 100 in a predetermined position. Further, it is conveyed in the conveyance path by the transfer cylinder 100 and passed to the conveying drum 61 of the fixing unit 60.

Here, as mentioned above, the drier 104 is installed inside the transfer cylinder 100, and hot air is blown to the guide plate 102. Therefore, drying processing is applied to paper P even at the time of conveyance by this transfer cylinder 100.

<Fixing Unit>

The fixing unit 60 irradiates ultraviolet rays to paper P and fixes an image recorded on the printing surface. This fixing unit 60 is mainly configured with a conveying drum (hereinafter referred to as "fixing drum") 61 that conveys paper P, an ultraviolet irradiation light source 62 that irradiates ultraviolet rays to the printing surface of paper P, and an inline sensor 64 that detects the temperature and humidity, and so on, of paper P after printing and photographs a printed image.

The fixing drum 61 receives paper P from the transfer cylinder 100 (receives it while holding the front edge of paper P by gripper G), and rotates and conveys paper P along the conveyance path.

The ultraviolet irradiation light source 62 irradiates ultraviolet rays to the printing surface of paper P conveyed by the fixing drum 61 and solidifies the aggregate of a process liquid and ink.

The inline sensor 64 includes a thermometer, a hygrometer and a CCD line sensor, and so on, detects the temperature and humidity, and so on, of paper P conveyed by the fixing drum 61, and reads out an image printed on paper P. Based on the detection result of this inline sensor 64, apparatus abnormality and ejection failure of a head, and so on, are checked.

In the fixing unit 60 of the above-mentioned configuration, paper P is conveyed in the conveyance path by the fixing drum 61. Further, ultraviolet rays are irradiated from the ultraviolet irradiation light source 62 to the printing surface in the conveyance process, and the aggregation of a process liquid and ink is solidified.

Afterward, paper P subjected to fixing processing is passed from the fixing drum 61 to the collection unit 70 in a predetermined position.

<Collection Unit>

The collection unit 70 stacks and collects paper P subjected to a series of print processing, on a stacker 71. This collection unit 70 is mainly configured with the stacker 71 that collects paper P, and a paper discharge conveyor 72 that receives paper P subjected to fixing processing in the fixing unit 60 from the fixing drum 61, conveys it in the conveyance path and discharges the paper to the stacker 71.

Paper P subjected to fixing processing in the fixing unit 60 is passed from the fixing drum 61 to the paper discharge conveyor 72, conveyed to the stacker 71 by the paper discharge conveyor 72 and collected in the stacker 71.

<<Control System>>

Figure 2:
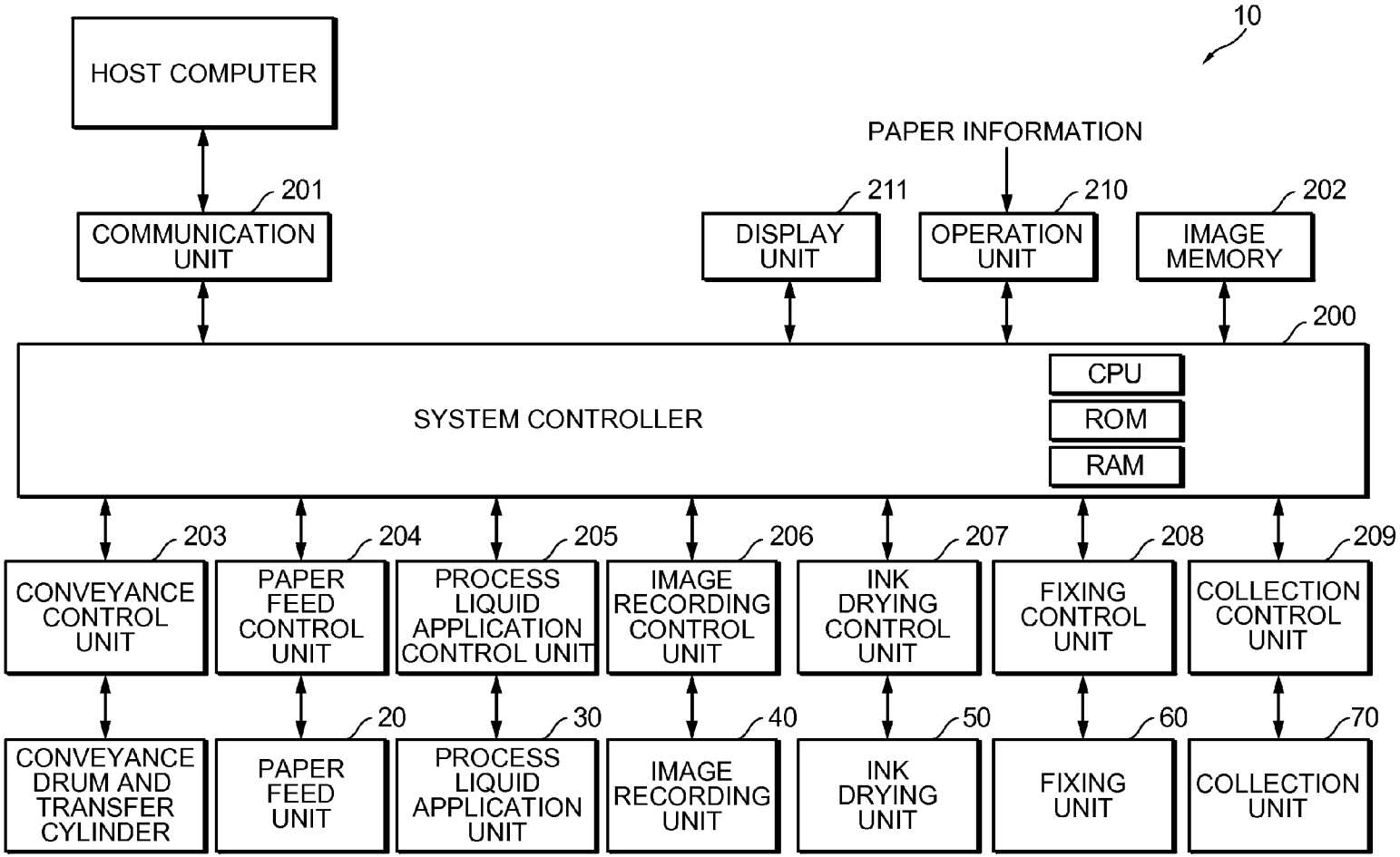
FIG. 2 is a block diagram illustrating a schematic configuration of a control system of an inkjet printing device.

FIG. 2 is a block diagram illustrating a schematic configuration of the control system of the inkjet printing device of the present embodiment.

As illustrated in the figure, the inkjet printing device 10 includes a system controller 200, a communication unit 201, an image memory 202, a conveyance control unit 203, a paper feed control unit 204, a process liquid application control unit 205, an image recording control unit 206, an ink drying control unit 207, a fixing control unit 208, a collection control unit 209, an operation unit 210 and a display unit 211, and so on.

The system controller 200 functions as a control device which integrally controls each unit of the inkjet printing device 10 and functions as an arithmetic device which performs various kinds of arithmetic processing. This system controller 200 includes a CPU, a ROM and a RAM, and so on, and operates according to a control program. The ROM stores a control program executed by this system controller 200 and various kinds of data required for control.

The communication unit 201 includes a necessary communication interface, and performs transmission and reception of data with a host computer connected with the communication interface.

The image memory 202 functions as a temporary storage device of various kinds of data including image data, and reads and writes data through the system controller 200. Image data imported from the host computer through the communication unit 201 is stored in this image memory 202.

The conveyance control unit 203 controls the drive of the conveying drums 31, 41, 51 and 61 and the transfer cylinders 80, 90 and 100, which are the conveying device of paper P in each unit of the process liquid application unit 30, the image recording unit 40, the ink drying unit 50 and the fixing unit 60.

That is, it controls the drive of a motor that drives respective conveying drums 31, 41, 51 and 61, and controls the opening and closing of gripper G installed in respective conveying drums 31, 41, 51 and 61.

Similarly, it controls the drive of a motor that drives respective transfer cylinders 80, 90 and 100, and controls the opening and closing of gripper G installed in respective transfer cylinders 80, 90 and 100.

Moreover, since respective conveying drums 31, 41, and 51 and 61 have a mechanism to adsorb and hold paper P on the peripheral surface, the drive of the adsorption holding mechanism is controlled (in the present embodiment, since paper P is subjected to vacuum adsorption, the drive of a vacuum pump as a negative pressure generation device is controlled).

Moreover, since the driers 84, 94 and 104 are installed in respective transfer cylinders 80, 90 and 100, the drive (thermal dose and blast volume) is controlled.

The drive of these conveying drums 31, 41, 51 and 61 and transfer cylinders 80, 90 and 100 is controlled according to an instruction from the system controller 200.

The paper feed control unit 204 controls the drive of each unit (the paper feed apparatus 21 and the transfer cylinder 23, and so on) forming the paper feed unit 20, according to an instruction from the system controller 200.

The process liquid application control unit 205 controls the drive of each unit (the application apparatus 32, and so on) forming the process liquid application unit 30, according to an instruction from the system controller 200.

The image recording control unit 206 controls the drive of each unit (the pressure roller 42, the paper float detection sensor 43, the inkjet heads 44C, 44M, 44Y and 44K, and the back tension giving apparatus 300, and so on) forming the image recording unit 40, according to an instruction from the system controller 200.

The ink drying control unit 207 controls the drive of each unit (the ink drying apparatus 52, and so on) forming the ink drying unit 50, according to an instruction from the system controller 200.

The fixing control unit 208 controls the drive of each unit (the ultraviolet irradiation light source 62 and the inline sensor 64, and so on) forming the fixing unit 60, according to an instruction from the system controller 200.

The collection control unit 209 controls the drive of each unit (the paper discharge conveyor 72, and so on) forming the collection unit 70, according to an instruction from the system controller 200.

The operation unit 210 includes a necessary operation device (for example, an operation button, a keyboard and a touch panel, and so on), and outputs operation information input from the operation device to the system controller 200. The system controller 200 performs various kinds of processing according to the operation information input from this operation unit 210.

Information of paper P as a print medium (information of the thickness and the kind (paper type), and so on) is input through this operation unit 210. Therefore, this operation unit 210 functions as a print medium information acquisition device.

The display unit 211 includes a necessary display apparatus (for example, an LCD panel, and so on), and displays necessary information on a display apparatus according to an instruction from the system controller 200.

As mentioned above, image data recorded in a paper is imported in the inkjet printing device 10 from the host computer through the communication unit 201 and stored in the image memory 202. The system controller 200 generates dot data by applying necessary signal processing to the image data stored in this image memory 202, and records an image shown by the image data on a paper by controlling the drive of each inkjet head of the image recording unit 40 according to the generated dot data.

The dot data is generally generated by performing color transformation processing and halftone processing on the image data. The color transformation processing denotes processing to convert image data expressed by sRGB or the like (for example, image data of 8-bit RGB) into ink amount data of each color of ink used in the inkjet printing device 10 (converted into ink amount data of each color of C, M, Y and K in this example). The halftone processing denotes processing to convert ink amount data of each color generated by the color transformation processing into dot data of each color by processing such as error diffusion.

The system controller 200 generates dot data of each color by performing the color transformation processing and the halftone processing on image data. Further, by controlling the drive of a corresponding inkjet head according to the generated dot data of each color, an image shown by image data is recorded on a paper.

<<Printing Operation>>

Next, printing operation by the above-mentioned inkjet printing device 10 is outlined.

When a paper feed instruction is output from the system controller 200 to the paper feed apparatus 21, paper P is fed from the paper feed apparatus 21 to the paper feed tray 22. Paper P fed to the paper feed tray 22 is passed to the process liquid application drum 31 of the process liquid application unit 30 through the transfer cylinder 23.

Paper P passed to the process liquid application drum 31 is conveyed in a conveyance path by the process liquid application drum 31, and a process liquid is applied to the printing surface by the application apparatus 32 in the conveyance process.

Paper P to which the process liquid is applied is passed from the process liquid application drum 31 to the transfer cylinder 80. Further, it is conveyed in the conveyance path by the transfer cylinder 80 and passed to the image recording drum 41 of the image recording unit 40. As for paper P, hot air is blown from the drier 84 installed in the transfer cylinder 80 to the printing surface in the conveyance process by the transfer cylinder 80, and the process liquid applied to the printing surface is dried.

Paper P passed from the transfer cylinder 80 to the image recording drum 41 is nipped by the pressure roller 42 first, and the back surface is made to contact the outer peripheral surface of the image recording drum 41.

In paper P having passed the pressure roller 42, afterward, the existence/nonexistence of float is detected by the paper float detection sensor 43. Here, when the float of paper P is detected, the conveyance is stopped. On the other hand, in a case where the float is not detected, it is conveyed to the inkjet heads 44C, 44M, 44Y and 44K as it is. Further, when it passes below respective inkjet heads 44C, 44M, 44Y and 44K, ink drops of ink of respective colors of C, M, Y and K ejected from respective inkjet heads 44C, 44M, 44Y and 44K, and a color image is drawn on the printing surface.

Paper P on which the image is drawn is passed from the image recording drum 41 to the transfer cylinder 90. Further, it is conveyed in the conveyance path by the transfer cylinder 90 and passed to the ink drying drum 51 of the ink drying unit 50. As for paper P, hot air is blown from the drier 94 installed in the transfer cylinder 90 to the printing surface in the conveyance process by the transfer cylinder 90, and ink given to the printing surface is dried.

Paper P passed to the ink drying drum 51 is conveyed in the conveyance path by the ink drying drum 51. Further, hot air is blown from the ink drying apparatus 52 to the printing surface by the conveyance process, and a liquid component remaining on the printing surface is dried.

Paper P subjected to drying processing is passed from the ink drying drum 51 to the transfer cylinder 100. Further, it is conveyed in the conveyance path by the transfer cylinder 100 and passed to the fixing drum 61 of the fixing unit 60. As for paper P, hot air is blown from the drier 104 installed in the transfer cylinder 100 to the printing surface in the conveyance process by the transfer cylinder 100, and ink given to the printing surface is further dried.

Paper P passed to the fixing drum 61 is conveyed in the conveyance path by the fixing drum 61. Further, ultraviolet rays are irradiated to the printing surface in the conveyance process, and the drawn image is fixed to paper P. Afterward, paper P is passed from the fixing drum 61 to the paper discharge conveyor 72 of the collection unit 70, conveyed to the stacker 71 by the paper discharge conveyor 72 and discharged into the stacker 71.

As mentioned above, in the inkjet printing device 10 of this example, paper P is conveyed by a drum, each processing such as the application and drying of a process liquid and the deposition, drying and fixing of an ink drop is applied to paper P in the conveyance process, and an image is recorded on paper P.

<<Details of Paper Conveying Mechanism (Print Medium-Conveying Device) in Image Recording Unit>>

Figure 3:
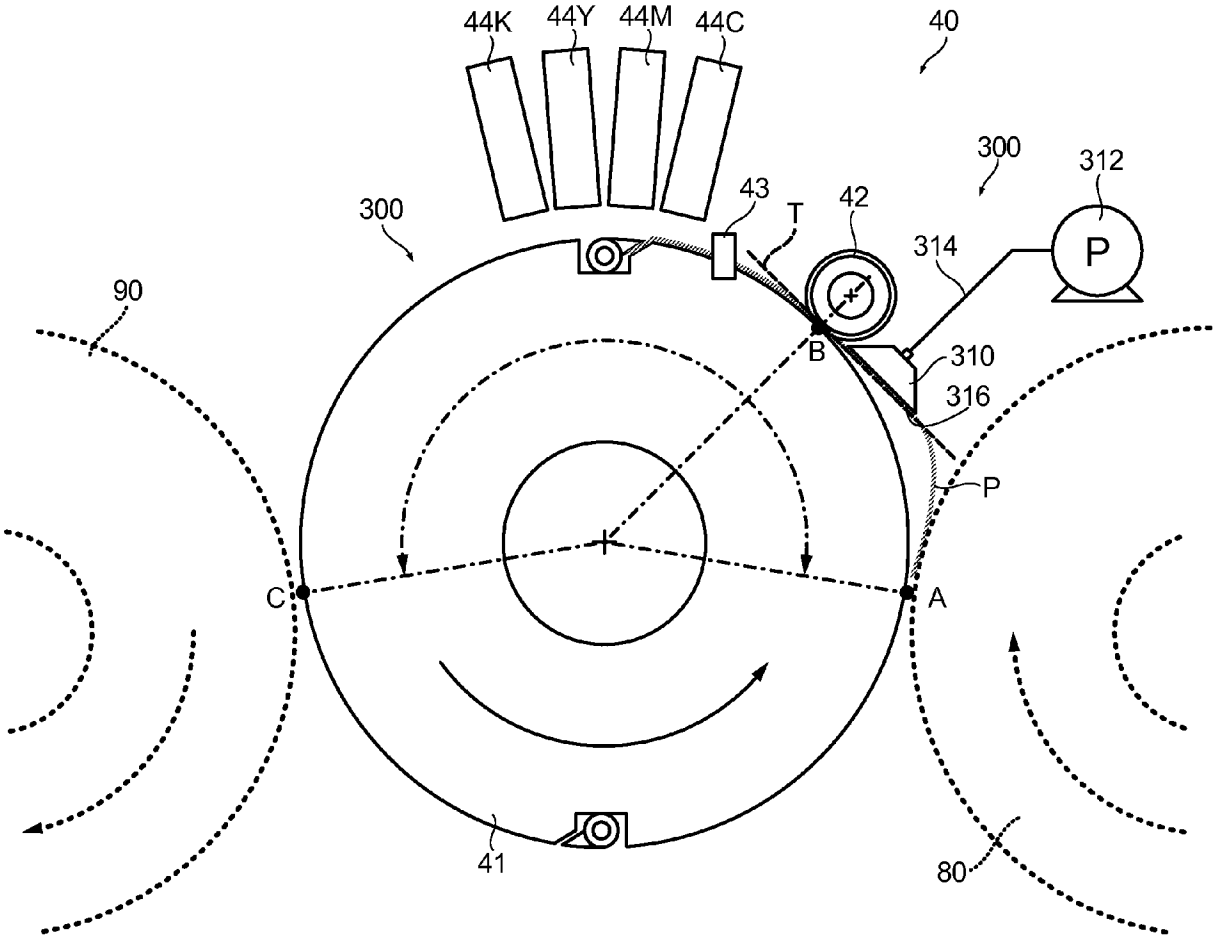
FIG. 3 is a side view illustrating a schematic configuration of a paper conveying mechanism of an image recording unit.
Figure 4:
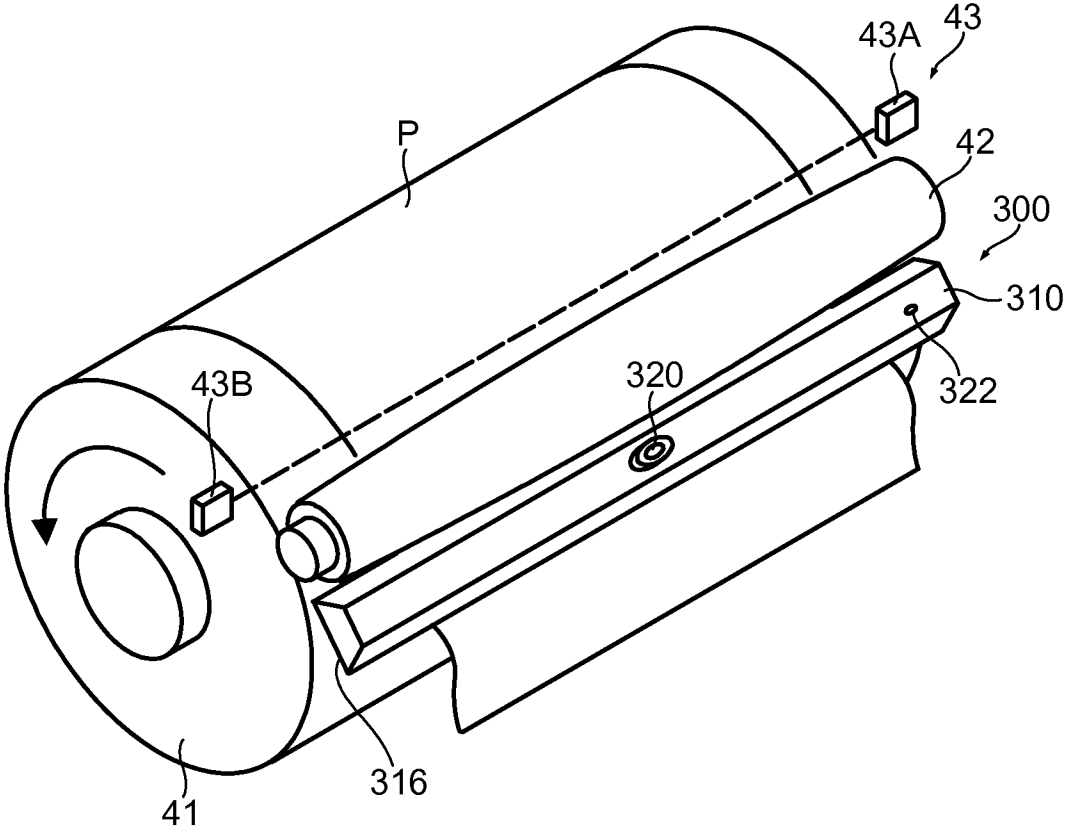
FIG. 4 is a perspective view illustrating a schematic configuration of a paper conveying mechanism of an image recording unit.

FIG. 3 is a side view illustrating a schematic configuration of the paper conveying mechanism of the image recording unit. Moreover, FIG. 4 is a perspective view illustrating a schematic configuration of the paper conveying mechanism of the image recording unit.

As mentioned above, the image recording unit 40 is configured including the image recording drum 41 that conveys paper P, the pressure roller 42 that nips paper P conveyed by the image recording drum 41 and makes it contact the peripheral surface of the image recording drum 41, the paper float detection sensor 43 that detects the float of paper P conveyed by the image recording drum 41, the inkjet heads 44C, 44M, 44Y and 44K that eject an ink drop to paper P conveyed by the image recording drum 41, and the back tension giving apparatus 300 that sucks the front surface (printing surface) of paper P in a position immediately before the pressure roller 42 and gives back tension to paper P.

The image recording drum 41 receives paper P conveyed by the transfer cylinder 80 in reception position A, rotates it around an axis and conveys paper P along an arc-shaped conveyance path. At this time, paper P is adsorbed and held on the outer peripheral surface and conveyed. That is, many suction holes are formed in a constant pattern on the peripheral surface of the image recording drum 41, and paper P wound on the outer peripheral surface is adsorbed and held by sucking air from the inside through these suction holes.

Here, the operation range of adsorption is limited in the image recording drum 41 of the present embodiment, and the adsorption operates only in a range from adsorption start position B to adsorption end position C. Here, adsorption start position B is set to a position separated by a constant distance from reception position A (position rotated by a constant angle), and adsorption end position C is set to a position in which paper P is passed to the transfer cylinder 90. Therefore, after paper P is conveyed by the constant distance from reception position A, the adsorption is started.

As illustrated in FIG. 4, the pressure roller 42 is disposed in the upstream position of the inkjet head with respect to the conveyance direction of paper P. In this example, it is disposed in adsorption start position B.

Figure 5:
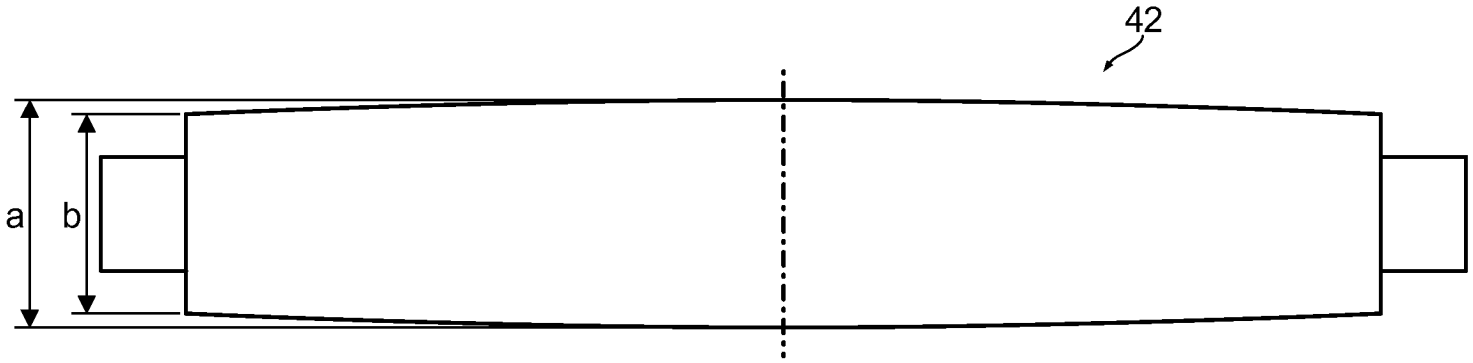
FIG. 5 is a plan view illustrating the configuration of a pressure roller.

This pressure roller 42 is configured with a rubber roller (here, a roller in which the surrounding of a metallic core (shaft part) is covered with rubber) having substantially the same width as the width of the image recording drum 41. Especially, in the present embodiment, as illustrated in FIG. 5, it is formed in a shape in which the outside diameter becomes smaller from the center to both ends (especially, a shape in which the outer diameter becomes smaller so as to form an arc shape). It is formed in a so-called crown shape.

The pressure roller 42 is disposed in parallel to the image recording drum 41 (disposed so as to be orthogonal to the conveyance direction of paper P), both ends of the shaft part are subjected to shaft support by an unillustrated shaft bearing, and it is supported so as to be rotatable. The shaft bearing is biased to the image recording drum 41 by predetermined biasing force by an unillustrated biasing mechanism (for example, spring). By this means, the pressure roller 42 is pressed and made to contact the outer peripheral surface of the image recording drum 41 by predetermined pressure force. Moreover, by this means, when the image recording drum 41 rotates, it rotates in synchronization with the rotation of the image recording drum 41 (so-called synchronous rotation).

When paper P passed to the image recording drum 41 in the reception position is conveyed to adsorption start position B, it is nipped by the pressure roller 42 and made to contact the outer peripheral surface of the image recording drum 41. Moreover, suction is started at the same time with this.

The paper float detection sensor 43 detects the float of paper P having passed the pressure roller 42. Therefore, the paper float detection sensor 43 is installed in the subsequent stage of the pressure roller 42 (downstream side in the conveyance direction of paper P by the image recording drum 41).

As illustrated in FIG. 4, this paper float detection sensor 43 is configured with the laser projector 43A that projects laser light, and the laser receiver 43B that receives the laser light.

The laser projector 43A projects laser light, which is parallel to the shaft of the image recording drum 41 in one end to the other end in the width direction of the image recording drum 41, from the outer peripheral surface of the image recording drum 41 to a position of predetermined height (position of the upper-limit height of float tolerance).

The laser receiver 43B is disposed facing the laser projector 43A across the running path of paper P by the image recording drum 41, and receives the laser light projected from the laser projector 43A. The laser receiver 43B detects the light receiving amount of the received laser light and outputs the detection result to the system controller 200.

The system controller 200 detects the float of paper P on the basis of the acquired information of the light receiving amount. That is, when float equal to or greater than allowance is caused in paper P, the laser light projected from the laser projector 43A is blocked by paper P. As a result of this, the laser receiving amount of laser light received in the laser receiver 43B decreases. The system controller 200 compares the light receiving amount of laser light received in this laser receiver 43B and a threshold, determines that the float (float equal to or greater than allowance) occurs in a case where the light receiving amount is equal to or less than the threshold, and detects this. By this means, it is possible to detect the float of paper P.

When detecting the float equal to or greater than the allowance, the system controller 200 stops the rotation of the image recording drum 41 and stops the conveyance of paper P. By this means, it is possible to prevent floating paper P from contacting the nozzle side of the inkjet head.

Here, the paper float detection sensor 43 is configured so as to be able to adjust the height of laser light projected and received in the laser projector 43A and the laser receiver 43B (height from the outer peripheral surface of the image recording drum 41). By this means, it is possible to arbitrarily set the tolerance of float according to the thickness or the like of paper P.

The adjustment of the height of projected/received laser light is performed by, for example, changing the installation height of the laser projector 43A and the laser receiver 43B. Besides this, it is also possible to install a transparent parallel plate (for example, glass parallel plate) whose angle is adjustable, before the laser projector 43A and the laser receiver 43B, and adjust the adjustment of the height of projected/received laser light by the use of refraction (if a transparent parallel plate is disposed so as to be orthogonal to the laser light, the laser light goes straight, but, by installing it in an inclined manner, it is refracted at the time of incidence and emission, and height adjustment can be performed).

Moreover, it is possible to exclude unnecessary light by installing an aperture in the prior stage of the laser projector 43A and the laser receiver 43B, and it is possible to perform detection at higher accuracy.

As for paper P conveyed by the image recording drum 41, as illustrated in FIG. 3, by sucking the front surface of paper P in a position immediately before it is pressed by the pressure roller 42 (position immediately before it enters between the image recording drum 41 and the pressure roller 42), the back tension giving apparatus 300 adsorbs and holds the front surface of paper P on the adsorption holding surface and gives back tension to paper P.

The back tension giving apparatus 300 is chiefly configured with a suction unit 310 and a vacuum pump 312.

The suction unit 310 is formed in a hollow box shape whose cross section parallel to the conveyance direction of paper P has a trapezoidal shape (box shape widened toward the end), and is formed corresponding to the paper width. Therefore, the width (width in a direction orthogonal to the conveyance direction of paper P) is formed to be substantially the same as the width of the image recording drum 41.

The surface on the image recording drum side of the suction unit 310 (lower surface) is formed in a flat manner, and this surface on the image recording drum side (lower surface) is assumed to be an adsorption holding surface 316 that adsorbs and holds the front surface (printing surface) of paper P.

The suction unit 310 is installed near the pressure roller 42, and the adsorption holding surface 316 is disposed so as to be along tangent T of the image recording drum 41 in the installation point of the pressure roller 42 (point in which the pressure roller 42 and the outer peripheral surface of the image recording drum 41 come into contact with each other (adsorption start position B in this example)) (it is disposed such that the installation point of the pressure roller 42 is located on the extension line of the adsorption holding surface 316).

Figure 6:
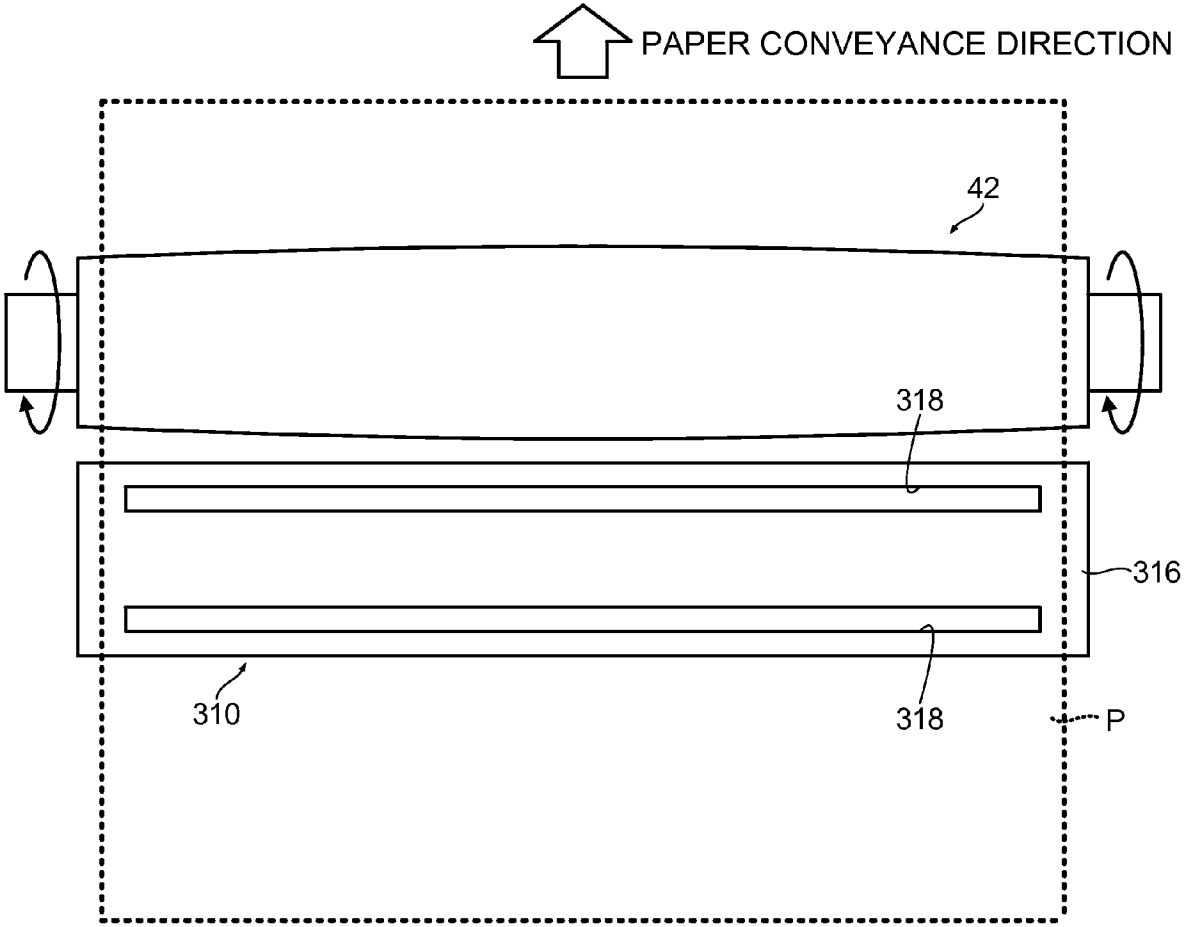
FIG. 6 is a bottom view of a suction unit (plan view of an adsorption holding surface).

FIG. 6 is a bottom view of the suction unit (plan view of the adsorption holding surface). As illustrated in this figure, a suction hole 318 is formed on the adsorption holding surface 316. The suction hole 318 is formed in a slit shape and formed in a direction orthogonal to the conveyance direction of paper P (formed in parallel to the shaft of the pressure roller 42). The suction hole 318 is communicated with the inside (hollow part) of the suction unit formed in a hollow shape.

The number of suction holes 318 is not especially limited. It is arbitrarily set according to the length in the front-back direction of the adsorption holding surface 316 (conveyance direction of paper P), and so on. In this example, two suction holes 318 are formed back and forth in the conveyance direction of paper P.

On the upper surface of the suction unit 310 (surface on the side opposite to the adsorption holding surface 316), a suction port 320 is formed in the central part. The suction port 320 is communicated with the inside (hollow part) of the suction unit 310 formed in a hollow shape. By sucking air from this suction port 320, the air is sucked from the suction hole 318 formed on the adsorption holding surface 316.

Moreover, vacuum prevention hole 322 is formed on the suction unit 310. A vacuum prevention hole 322 releases pressure in the suction unit 310 and prevents excessive suction force from operating. Since the vacuum prevention hole 322 is provided to prevent excessive suction force from operating in this way, the installation position, size and installation number thereof are arbitrarily adjusted in a range in which the object is achieved.

The vacuum pump 312 is connected with the suction port 320 of the suction unit 310 through piping 314. The inside (hollow part) of the suction unit 310 is sucked by driving this vacuum pump 312, the negative pressure is sucked from the suction hole 318 formed on the adsorption holding surface 316.

Here, the suction from the suction hole 318 is stopped by stopping the drive of the vacuum pump 312. Therefore, it is possible to control the ON/OFF of suction from the suction hole 318 by controlling the drive of this vacuum pump 312 (ON/OFF), and it is possible to control the ON/OFF of back tension giving.

The drive of the vacuum pump 312 is controlled by the system controller 200 through the image recording control unit 206. The system controller 200 controls the ON/OFF of back tension giving on the basis of information of paper P input from the operation unit 210. Specifically, it controls the ON/OFF of back tension giving on the basis of information of the thickness of paper P. This point is described below.

The back tension giving apparatus 300 is provided to prevent float and wrinkles from being caused in paper P adsorbed and held on the peripheral surface of the image recording drum 41 by giving back tension to paper P that enters between the image recording drum 41 and the pressure roller 42.

However, regarding paper P having so-called stiffness, it is possible to adsorb and hold it on the peripheral surface of the image recording drum 41 without causing float and wrinkles even if the back tension is not given. By contrast, when the back tension is given to paper P with strong stiffness, there is a danger that the front surface of paper P is strongly pressed against the adsorption holding surface 316 of the suction unit 310 and the front surface of paper P is damaged. Especially, the damage becomes remarkable in a paper of high smoothness (glossiness) such as a gloss paper.

Therefore, in the inkjet printing device 10 of the present embodiment, it is assumed that information of the thickness of paper P is acquired and back tension giving is turned on/off according to the thickness of conveyed paper P. That is, since the strength of stiffness of paper P is mainly based on the thickness of paper P, the back tension giving is turned off for paper P equal to or greater than constant thickness. That is, the drive of the vacuum pump 312 is stopped.

By this means, it is possible to appropriately give back tension and convey paper P, and it is possible to convey paper P without causing float, wrinkles and damage.

Here, the thickness of paper P as a determination criterion of ON/OFF of back tension giving is defined as a threshold (thickness threshold) beforehand and stored in the ROM of the system controller 200. The system controller 200 compares the thickness of paper P acquired from the operation unit 210 and the threshold (thickness threshold), turns on back tension giving in a case where the thickness is less than the threshold, and turns off back tension giving in a case where it is equal to or greater than the threshold.

The threshold is, for example, 0.13 mm in the case of a paper used for printing. Therefore, in this case, the back tension giving is turned on when the used paper is less than 0.13 mm, and the back tension giving is turned off when it is equal to or greater than 0.13 mm.

The back tension giving apparatus 300 is configured as mentioned above.

<<Operation of Paper Conveying Mechanism in Image Recording Unit>>

<Entire Flow of Paper Conveyance>

First, the entire flow of paper conveyance in the image recording unit 40 is described.

Paper P is passed from the transfer cylinder 80 to the image recording drum 41. The image recording drum 41 receives paper P from the transfer cylinder 80 in reception position A. The reception of paper P is performed by holding the front edge of paper P by gripper G. This reception of paper P is performed while performing rotation.

Paper P whose front edge is held by gripper G is conveyed by rotation of the image recording drum 41. Further, the front surface (printing surface) is pressed by the pressure roller 42 in the installation position of the pressure roller 42 and made to contact the outer peripheral surface of the image recording drum 41.

Here, in the inkjet printing device 10 of this example, the suction unit 310 of the back tension giving apparatus 300 is installed in front of the pressure roller 42 (upstream side in the conveyance direction of paper P).

In a case where back tension giving is turned on, the front surface of paper P is sucked by this back tension giving apparatus 300 and the back tension is given to paper P. Paper P is extended in the conveyance direction when this back tension is given, and the deformation (distortion) caused in paper P is removed. Further, when paper P enters between the pressure roller 42 and the image recording drum 41 in a state where this back tension is given, it is possible to wind paper P around the peripheral surface of the image recording drum 41 without causing wrinkles and float.

On the other hand, in a case where the back tension giving is turned off, the back tension is not given to paper P, and it enters between the image recording drum 41 and the pressure roller 42 as it is.

In the image recording drum 41, since suction from the installation point of the pressure roller 42 operates, the back surface is sucked from a suction hole formed on the outer peripheral surface of the image recording drum 41 simultaneously with pressure by the pressure roller 42, and paper P is adsorbed and held on the outer peripheral surface of the image recording drum 41.

Afterward, when paper P passes through the paper float detection sensor 43, after the existence/nonexistence of float is detected, it passes through the installation positions of the inkjet head 44C, 44M, 44Y and 44K and an image is recorded on the front surface.

<ON/OFF of Back Tension Giving>

As mentioned above, in the inkjet printing device 10 of the present embodiment, back tension giving is turned on/off according to the thickness of used paper P.

Information of paper P including thickness information is input by an operator from the operation unit 210 before printing starts. The system controller 200 acquires the information of paper P input from the operation unit 210 and compares it with a threshold (thickness threshold). Further, the back tension giving is turned on in a case where the thickness of paper P is less than the threshold, and the back tension giving is turned off in a case where it is equal to or greater than the threshold.

The vacuum pump 312 is driven when the back tension giving is turned on, and air is sucked from the suction hole 318 formed on the adsorption holding surface 316 of the suction unit 310. By this means, it is possible to given back tension to paper P passed to the image recording drum 41 immediately before it enters between the image recording drum 41 and the pressure roller 42.

On the other hand, when the back tension giving is turned off, the vacuum pump 312 is not driven. In this case, since air is not sucked from the suction hole 318, paper P is not adsorbed and held on the adsorption holding surface 316 and enters between the image recording drum 41 and the pressure roller 42.

As mentioned above, ON/OFF of back tension giving is determined on the basis of the thickness of paper P.

By giving back tension to thin paper P of weak stiffness, it is possible to make paper P enter between the image recording drum 41 and the pressure roller 42 in a state where it is tightened up to the rear end of paper P, and it is possible to adsorb and hold it on the peripheral surface of the image recording drum 41 without causing float and wrinkles.

Meanwhile, when the back tension is given, thick paper P has strong stiffness and therefore is strongly pressed against the adsorption holding surface 316, and there is a danger that the front surface is damaged. Meanwhile, since thick paper P has strong stiffness, even if the back tension is not given, it is possible to adsorb and hold it on the peripheral surface of the image recording drum 41 without causing float and wrinkles. Moreover, even in a case where an image is already recorded on the back surface side (at the time of so-called back surface printing), thick paper P is subjected to less paper deformation, and, even if the back tension is not given, it is possible to adsorb and hold it on the peripheral surface of the image recording drum 41 without causing float and wrinkles. Therefore, thick paper P is adsorbed and held on the peripheral surface of the image recording drum 41 without back tension giving. By this means, it is possible to convey paper P without causing float, wrinkles and damage.

<<Another Embodiment of Paper Conveying Mechanism (Print Medium-Conveying Device) in Image Recording Unit>>

<Another Example (1) of Paper Conveying Mechanism>

Figure 7:
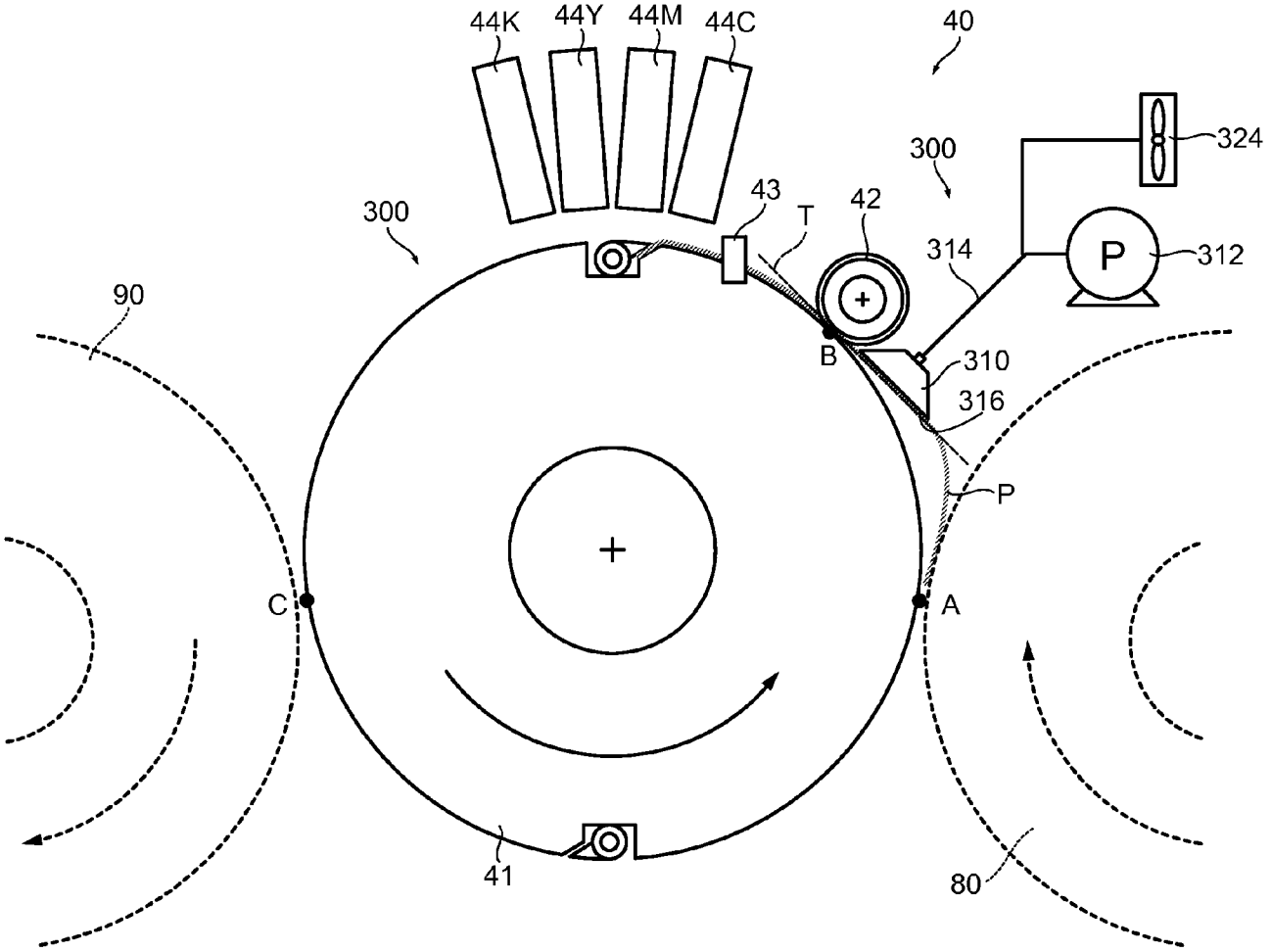
FIG. 7 is a side view illustrating another configuration of the paper conveying mechanism of the image recording unit.

FIG. 7 is a side view illustrating another configuration of the paper conveying mechanism of the image recording unit.

In the above-mentioned embodiment, there is provided a configuration in which back tension giving is turned on/off by turning on/off the drive of the vacuum pump 312. That is, there is provided a configuration in which the back tension giving is turned on/off by turning on/off suction from the suction hole 318 installed in the suction unit 310.

In this example, the back tension giving is turned on/off by switching suction and ventilation from the suction hole 318. Here, since others than a mechanism to turn on/off the back tension giving are the same as the configuration of the paper conveying mechanism of the above-mentioned embodiment, only the mechanism to turn on/off the back tension giving is described here.

As illustrated in FIG. 7, in the paper conveying mechanism of this example, the piping 314 connected with the suction unit 310 is formed by diverging on the way. One end of the diverging piping 314 is connected with the vacuum pump 312 and the other end is connected with a ventilation fan 324.

The inside of the suction unit 310 is sucked by driving the vacuum pump 312, the inside is assumed to have negative pressure, and it is sucked from the suction hole 318 formed on the adsorption holding surface 316.

Meanwhile, air is blown to the inside (hollow part) of the suction unit 310 by driving the ventilation fan 324, the inside of the suction unit is assumed to have positive pressure, and the air is ventilated from the suction hole 318 formed on the adsorption holding surface 316.

The vacuum pump 312 is driven in a case where the back tension giving is turned on, and the ventilation fan 324 is driven in a case where the back tension giving is turned off.

The drive of the vacuum pump 312 and the drive of the ventilation fan 324 are controlled by the system controller 200 through the image recording control unit 206. The system controller 200 controls the drive of the vacuum pump 312 and the drive of the ventilation fan 324 on the basis of information of paper P input from the operation unit 210 and controls ON/OFF of back tension giving. In the following, the control of ON/OFF of back tension giving is described.

ON/OFF of the back tension giving is controlled according to the thickness of used paper P. The information of paper P including thickness information is input by an operator from the operation unit 210 before printing starts. The system controller 200 acquires the information of paper P input from the operation unit 210 and compares it with a threshold (thickness threshold). Further, the back tension giving is turned on in a case where the thickness of paper P is less than the threshold, and the back tension giving is turned off in a case where it is equal to or greater than the threshold.

When the back tension giving is turned on, the vacuum pump 312 is driven (the ventilation fan 324 is turned off). By this means, the suction unit 310 is sucked, the inside of the suction unit 310 is assumed to have negative pressure, and air is sucked from the suction hole 318 formed on the adsorption holding surface 316 of the suction unit 310. By this means, it is possible to give back tension to paper P passed to the image recording drum 41 immediately before it enters between the image recording drum 41 and the pressure roller 42.

On the other hand, when the back tension giving is turned off, the ventilation fan 324 is driven (the vacuum pump 312 is turned off). By this means, air is blown to the suction unit 310, the inside of the suction unit 310 is assumed to have positive pressure, and the air is ventilated from the suction hole 318 formed on the adsorption holding surface 316 of the suction unit 310. By this means, paper P passed to the image recording drum 41 is prevented from contacting the adsorption holding surface 316.

ON/OFF of the back tension giving is determined on the basis of the thickness of paper P, and the back tension giving is turned on in a case where the thickness is less than a threshold. That is, the back tension giving is turned on for a thin paper less than a constant level. Since thin paper P has weak stiffness, by giving back tension, it is possible to make paper P enter between the image recording drum 41 and the pressure to roller 42 in a state where it is tightened up to the rear end of paper P, and it is possible to adsorb and hold it on the peripheral surface of the image recording drum 41 without causing float and wrinkles.

Meanwhile, since thick paper P has strong stiffness, it is possible to adsorb and hold it on the peripheral surface of the image recording drum 41 without causing float and wrinkles even if back tension is not given. By contrast, when back tension is given, the front surface is strongly pressed against the adsorption holding surface 316, and damage occurs. According to this example, since air is ventilated from the adsorption holding surface 316 when the back tension giving is turned off, it is possible to adsorb and hold paper P on the peripheral surface of the image recording drum 41 without making the front surface of paper P contact the adsorption holding surface 316. By this means, it is possible to convey paper P without causing damage on the front surface of paper P. Especially, even in a case where a gloss paper of high smoothness (glossiness) is conveyed, it is possible to convey it while preventing damage reliably. By this means, it is possible to record an image of high grade.

<Another Example (2) of Paper Conveying Mechanism>

Figure 8:
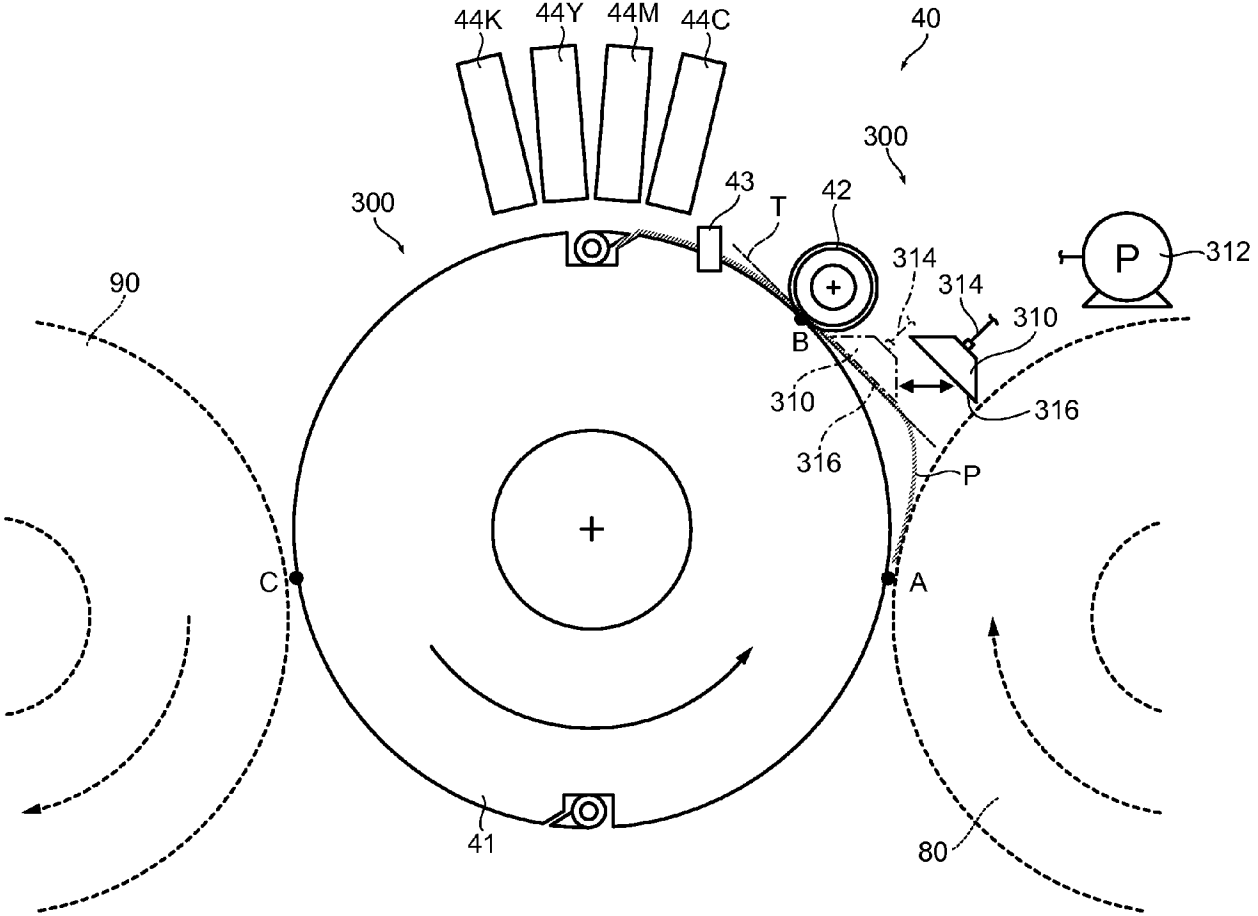
FIG. 8 is a side view illustrating another configuration of the paper conveying mechanism of the image recording unit.

FIG. 8 is a side view illustrating another configuration of the paper conveying mechanism of the image recording unit.

As illustrate in the figure, the suction unit 310 is installed so as to be movable in this example. The suction unit 310 is installed so as to be able to move forward and backward with respect to the outer peripheral surface of the image recording drum 41, and it is installed so as to be movable between "evacuation position" shown by the solid line and "adsorption position" shown by the dashed line by an unillustrated suction unit moving mechanism.

Here, the adsorption position (first position) is set to a position in which the front surface of paper P immediately before entering between the image recording drum 41 and the pressure roller 42 can be adsorbed and held by the adsorption holding surface 316 when the vacuum pump 312 is operated.

Meanwhile, the evacuation position (second position) is set to a position in which the front surface of paper P immediately before entering between the image recording drum 41 and the pressure roller 42 cannot be adsorbed and held by the adsorption holding surface 316 even in a state where the vacuum pump 312 is operated.

For example, the suction unit moving mechanism (not illustrated) is configured with a guide device which guides the movement of the suction unit 310 and a drive device which moves the suction unit 310 according to the guide device.

For example, the guide device is configured with a guide rail. The suction unit 310 is installed so as to be able to move forward and backward with respect to the outer peripheral surface of the image recording drum 41 by being installed so as to movable along this guide rail.

For example, the drive device is configured with a screw feeding mechanism, and includes a screw rod disposed along the guide rail, a nut member screwed with the screw rod, and a motor that rotates the screw rod. The suction unit 310 is connected with the nut member. When the motor is driven and the screw rod is rotated, the suction unit 310 moves along the guide rail and moves between the adsorption position and the evacuation position.

The suction unit 310 is moved to the adsorption position in a case where back tension giving is turned on, and the suction unit 310 is moved to the evacuation position in a case where the back tension giving is turned off.

The movement of the suction unit 310 is controlled by the system controller 200 through the image recording control unit 206. The system controller 200 controls the drive of the drive device of the suction unit moving mechanism on the basis of information of paper P input from the operation unit 210, controls the position of the suction unit 310 and controls ON/OFF of the back tension giving. In the following, the control of ON/OFF of this back tension giving is described.

ON/OFF of the back tension giving is controlled according to the thickness of used paper P. Information of paper P including thickness information is input by an operator from the operation unit 210 before printing starts. The system controller 200 acquires the information of paper P input from the operation unit 210 and compares it with a threshold (thickness threshold). Further, the back tension giving is turned on in a case where the thickness of paper P is less than the threshold, and the back tension giving is turned off in a case where it is equal to or greater than the threshold.

When the back tension giving is turned on, the position of the suction unit 310 is set to the adsorption position. Here, when the suction unit 310 is not located in the adsorption position, the drive device of the suction unit moving mechanism is driven and the suction unit 310 moves to the adsorption position. By this means, the front surface of paper P can be adsorbed and held by the adsorption holding surface 316 immediately before it enters between the image recording drum 41 and the pressure roller 42, and it is possible to give back tension to paper P.

On the other hand, when the back tension giving is turned off, the position of the suction unit 310 is set to the evacuation position. Here, when the suction unit 310 is not located in the evacuation position, the drive device of the suction unit moving mechanism is driven and the suction unit 310 moves to the evacuation position. By this means, even in a state where air is sucked from the suction hole 318, it is possible to convey paper P without making it contact the adsorption holding surface 316 while paper P is not adsorbed and held by the adsorption holding surface 316.

Here, in this example, there is provided a configuration in which the back tension giving is turned on/off by moving the suction unit 310 in a state where it is sucked from the suction hole 318, but a configuration is also possible in which suction from the suction hole 318 is turned on/off at the same time as the movement of the suction unit 310. That is, in a case where the back tension giving is turned on, the suction unit 310 is moved to the adsorption position, the vacuum pump 312 is driven and the suction from the suction hole 318 is turned on. On the other hand, in a case where the back tension giving is turned off, the suction unit 310 is moved to the evacuation position, the drive of the vacuum pump 312 is stopped and the suction from the suction hole 318 is turned off. By this means, when the back tension giving is turned off, it is possible to prevent paper P from contacting the adsorption holding surface 316 more reliably.

Similarly, in a case where a function to perform ventilation from the suction hole 318 is provided (see FIG. 7), a configuration is also possible in which suction and ventilation from the suction hole 318 are switched at the same time as the movement of the suction unit 310. That is, in a case where the back tension giving is turned on, the suction unit 310 is moved to the adsorption position, the vacuum pump 312 is driven and the suction from the suction hole 318 is turned on. On the other hand, in a case where the back tension giving is turned off, the suction unit 310 is moved to the evacuation position, the drive of the ventilation fan 324 is stopped and air is ventilated from the suction hole 318. By this means, when the back tension giving is turned off, it is possible to prevent paper P from contacting the adsorption holding surface 316 more reliably.

Figure 9:
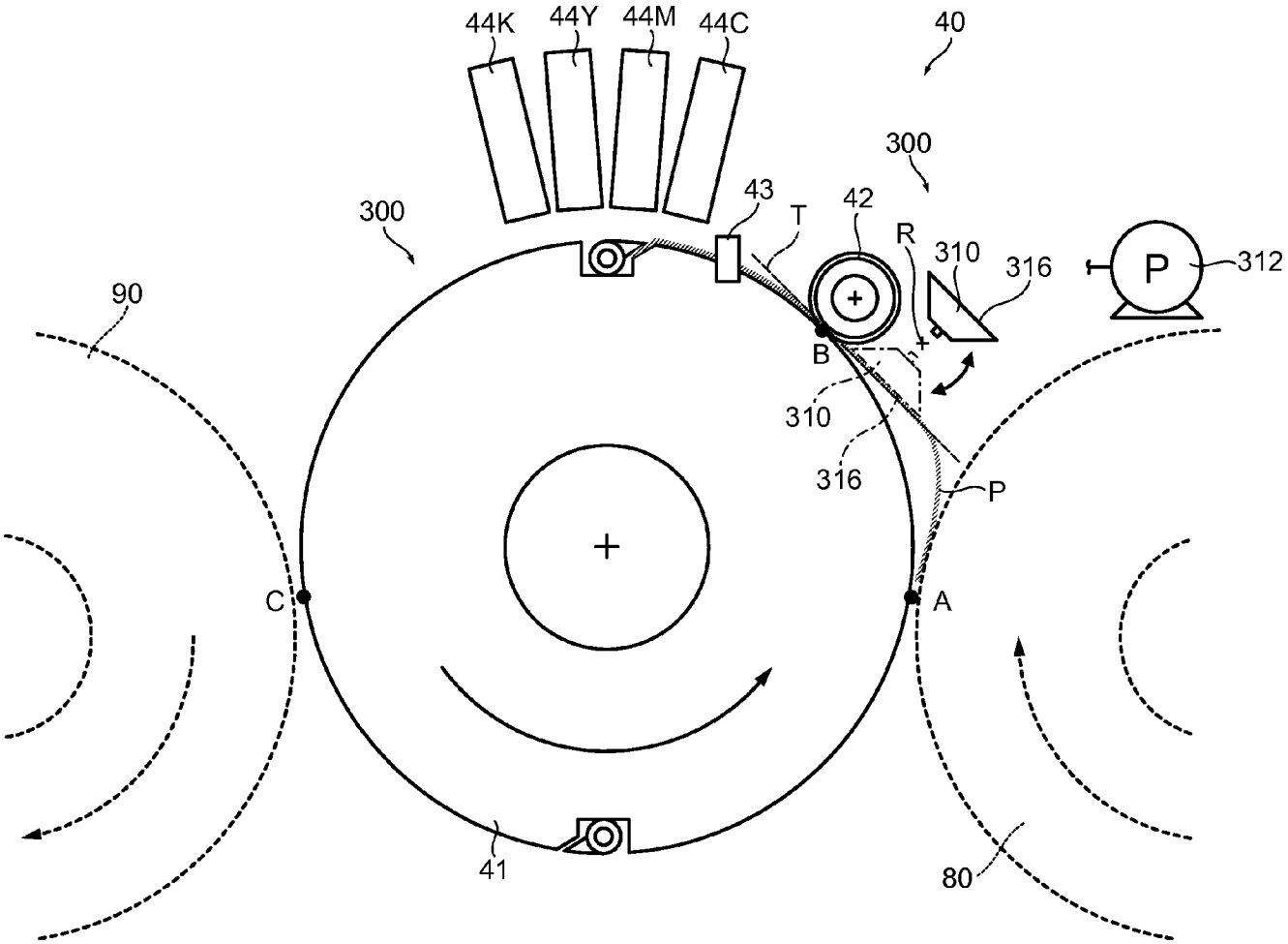
FIG. 9 is a side view illustrating another configuration of the paper conveying mechanism of the image recording unit.

Moreover, in this example, there is provided a configuration in which the suction unit 310 is linearly operated and moved between the adsorption position and the evacuation position, but a specific configuration to move the suction unit 310 is not especially limited. It only has to provide a configuration in which it is movable between a position in which the front surface of linear paper P that enters between the image recording drum 41 and the pressure roller 42 can be adsorbed and held (adsorption position) and a position in which it cannot be adsorbed and held (evacuation position). Therefore, for example, as illustrated in FIG. 9, a configuration is also possible in which the suction unit 310 is supported so as to be rotatable around axis R parallel to the rotation axis of the image recording drum 41 of the suction unit 310, rotated by a rotation drive device (not illustrated) and moved between the adsorption position (position in the state shown by the dashed line) and the evacuation position (position in the state shown by the solid line).

<Another Mode of Pressure Roller>

In the inkjet printing device 10 of the above-mentioned embodiment, there is provided a configuration in which paper P is made to contact the peripheral surface of the image recording drum 41 by nipping paper P passed to the image recording drum 41. Further, in the inkjet printing device 10 of the above-mentioned embodiment, there is provided a configuration in which paper P is pressed by a pressure roller of so-called crown shape (pressure roller formed such that the outside diameter becomes smaller from the center to both ends). The shape of the pressure roller 42 is not limited to this, and, for example, it is also possible to use a straight-shaped pressure roller (pressure roller whose outside diameter is constant).

However, it is possible to give tension to paper P in the width direction by using the crown-shaped pressure roller as shown in the above-mentioned embodiment, and it is possible to prevent the occurrence of wrinkles and float more effectively.

There are other shapes of a pressure roller that can effectively prevent the occurrence of wrinkles and float.

Figure 10:
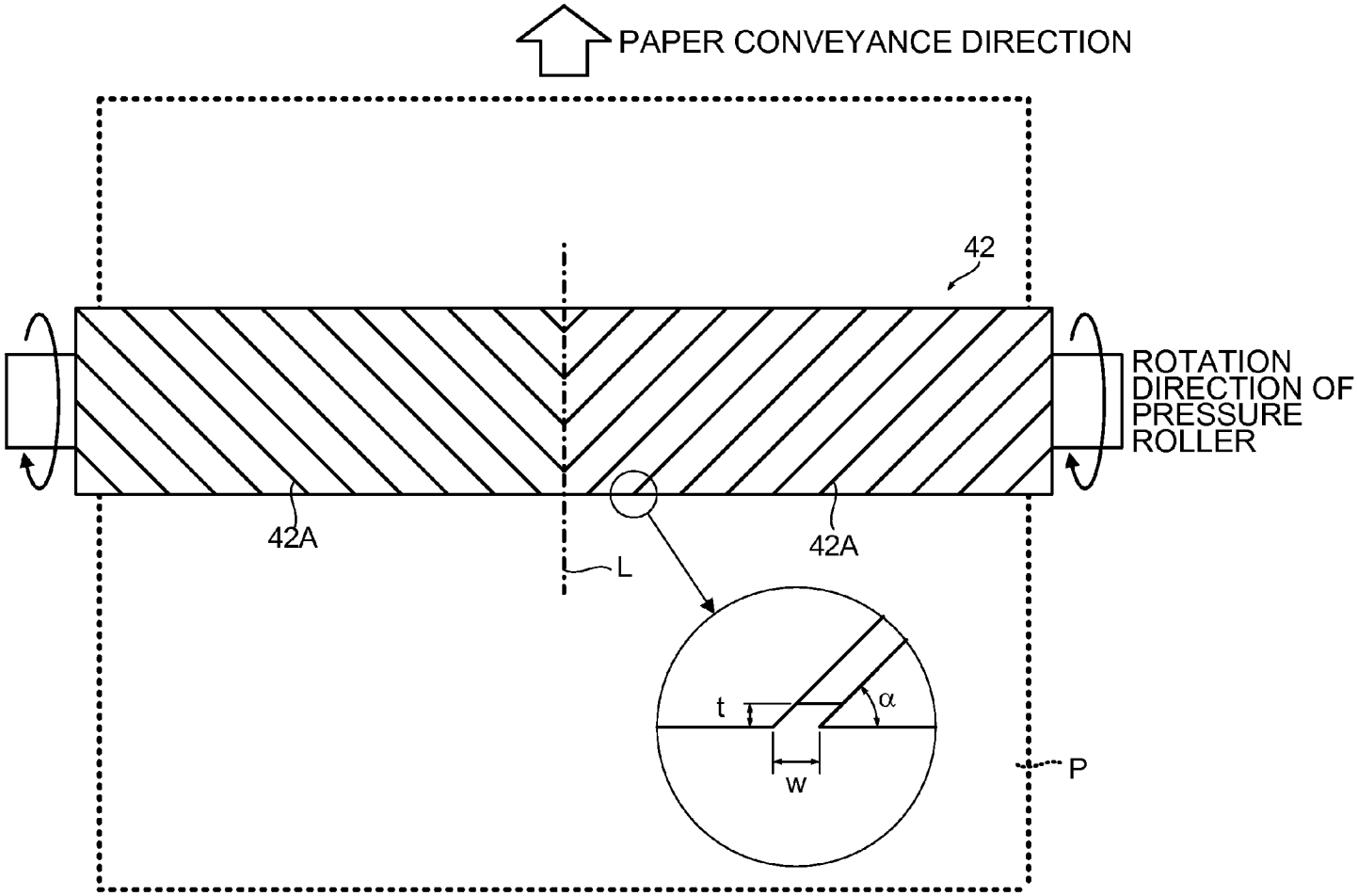
FIG. 10 is a plan view illustrating another mode of the pressure roller.

FIG. 10 is a plan view illustrating another mode of the pressure roller.

As illustrated in this figure, in the pressure roller 42 of the present embodiment, the entire area in the width direction is formed with the same diameter (column shape), and a spiral groove 42A is formed from the center to the outside on the peripheral surface.

Here, the groove 42A is formed symmetrically with respect to the center in the width direction of the pressure roller 42 (it is formed symmetrically with respect to straight line L passing through the center in the width direction (straight line L is a straight line orthogonal to the rotation axis of the pressure roller 42)).

Moreover, the groove 42A is formed so as to face to the inside with respect to the rotation direction of the pressure roller 42. That is, it is formed so as to face the center in the width direction of the pressure roller 42 from the upstream side to downstream side in the rotation direction of the pressure roller 42 (as compared with the position of a groove on the upstream side, the position of a groove on the downstream side is formed so as to be located in a position close to the center in the width direction of the pressure roller 42).

Figure 11:
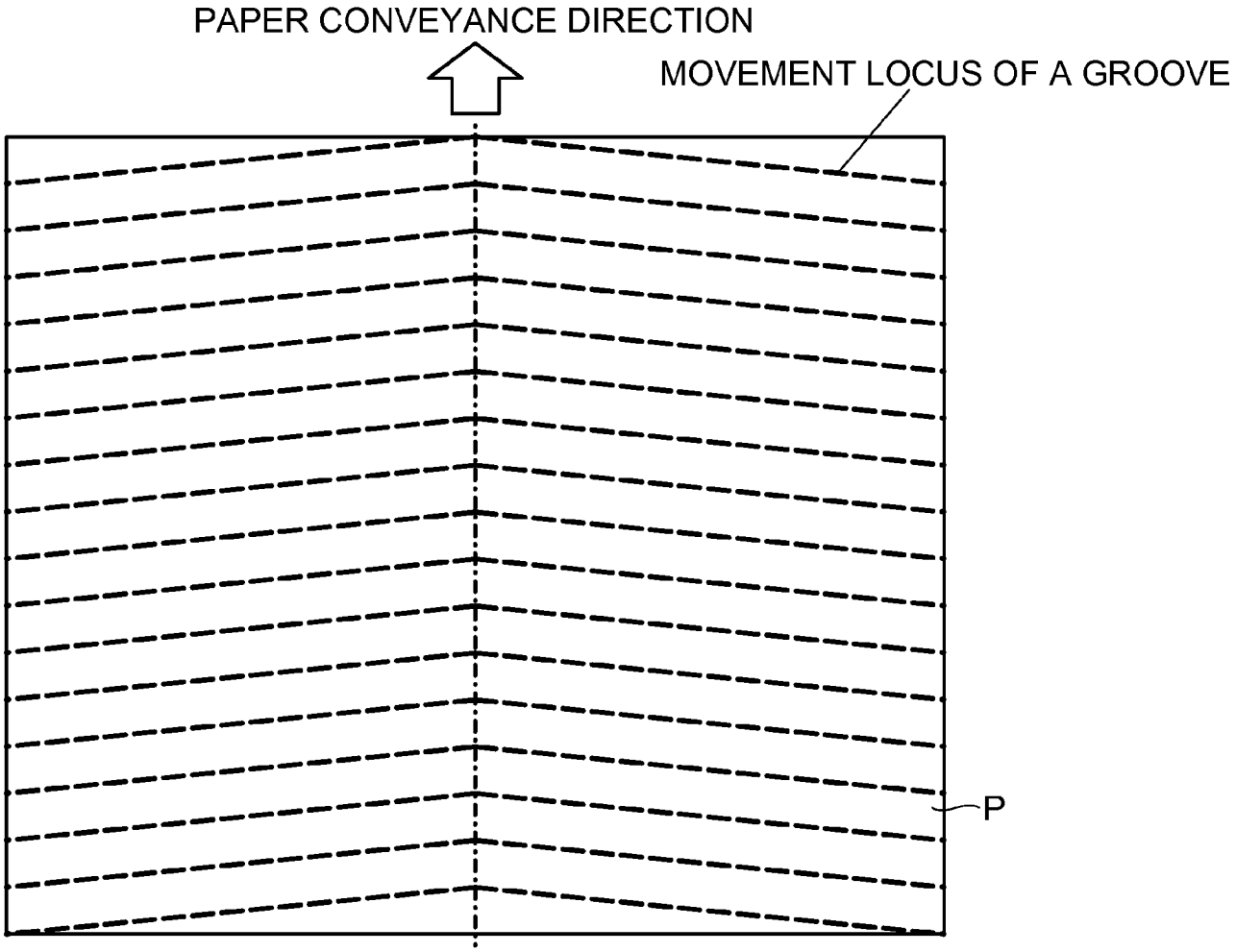
FIG. 11 is a diagram illustrating a relative movement locus of a groove with respect to a paper.

The pressure roller 42 formed in this way rotates according to the running of paper P (synchronous rotation) when it is pressed against paper P on the image recording drum. FIG. 11 is a diagram illustrating a relative movement locus of the groove 42A with respect to paper P (diagram illustrating the movement locus of the groove 42A when it passes above paper P). As illustrated in the figure, the groove 42A moves from the central part to the outside back in the width direction of paper P. Further, when this groove 42A moves from the center part to the outside back in the width direction of paper P, it is possible to cause operation to rub paper P from the central part to the outside back (paper P is rubbed in the edge part of the groove 42A), and it is possible to release deformation (distortion) caused in paper P in the width direction. That is, it is possible to provide an effect similar to the crown-shaped pressure roller mentioned above.

Here, the pressure roller 42 can adjust the force to rub paper P in the width direction by adjusting tilt angle $\alpha$ of the spiral groove 42A formed on the peripheral surface (angle formed by the spiral groove 42A with a straight line parallel to the rotation axis of the pressure roller 42). That is, by adjusting this tilt angle α, it is possible to adjust the size of wrinkle to be removed, and so on.

Therefore, it is preferable that multiple pressure rollers 42 of different tilt angle α are provided beforehand and arbitrarily exchanged.

Here, depth t and width w of the groove 42A are not especially limited, it is preferable that it is formed such that the entire surface of paper P can be nipped by predetermined pressure force, and it is preferable that the depth is equal to or less than 2 mm and the width is equal to or less than 10 mm.

<Other Modes of Adsorption Holding Surface>

The shape of the adsorption holding surface 316 of the suction unit 310 is assumed to be flat in the above-mentioned embodiment, but the shape of the adsorption holding surface 316 is not limited to this. In the following, other modes of the adsorption holding surface 316 of the suction unit 310 are described.

Figure 12A:
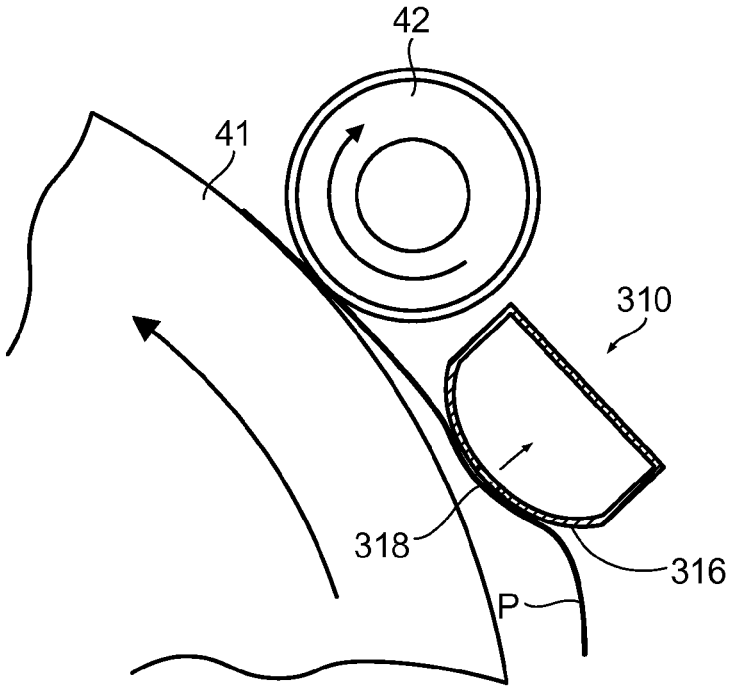
FIG. 12A is a diagram illustrating another mode of the adsorption holding surface of the suction unit.
Figure 12B:
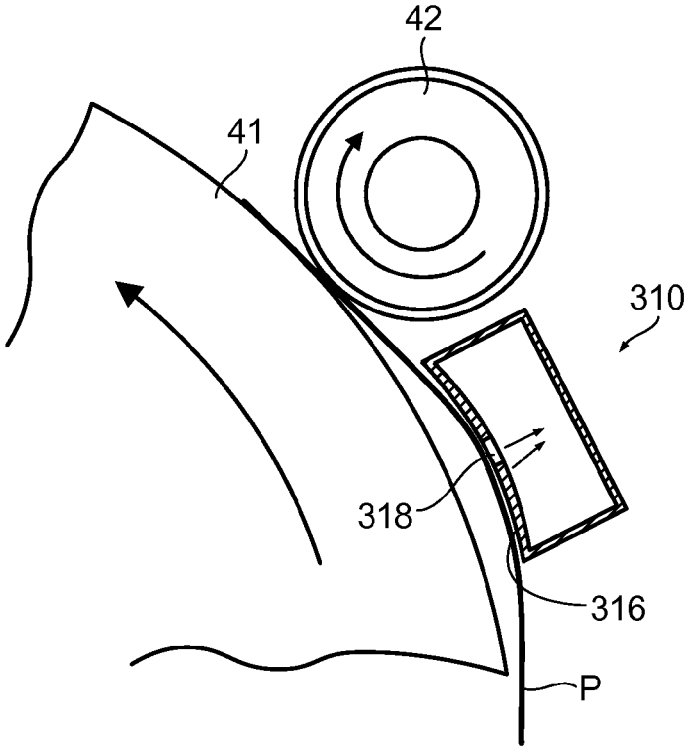
FIG. 12B is a diagram illustrating another mode of the adsorption holding surface of the suction unit.

FIGS. 12A and 12B are diagrams illustrating other modes of the adsorption holding surface of the suction unit.

In FIG. 12A, the shape of the cross section in the front-back direction of the adsorption holding surface 316 (direction parallel to the conveyance direction of paper P) is assumed to be an arc shape that becomes convex toward the image recording drum 41.

Moreover, in FIG. 12B, the shape of the cross section in the front-back direction of the adsorption holding surface 316 (direction parallel to the conveyance direction of paper P) is assumed to be an arc shape that becomes concave toward the image recording drum 41.

Thus, by assuming the shape of the cross section in the direction parallel to the conveyance direction of paper P to be the arc shape, it is possible to increase the contact area of paper P. By this means, it is possible to increase the adsorption holding force and perform guide of paper P stably.

Here, the suction hole 318 is formed only in the center in the front-back direction of the adsorption holding surface 316 in the example illustrated in the figure, but it can be formed in multiple positions along the front-back direction. By this means, it is possible to increase the contact area more.

Moreover, it is preferable that the curvature of the arc shape is set taking into account the setting position or the like of the suction unit 310 such that paper P is easily guided between the pressure roller 42 and the image recording drum 41.

Figure 13:
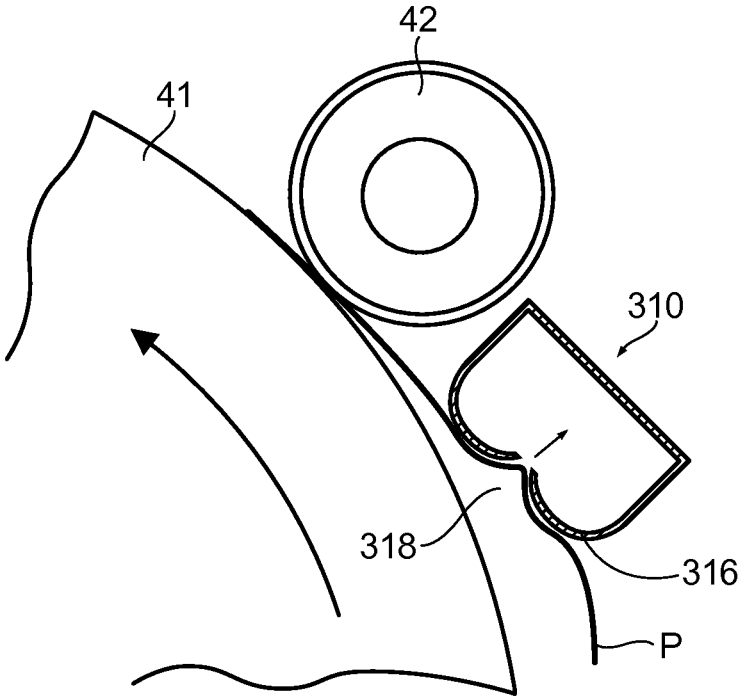
FIG. 13 is a diagram illustrating another mode of the adsorption holding surface of the suction unit.

FIG. 13 is a diagram illustrating another mode of the adsorption holding surface of the suction unit.

As illustrated in the figure, in this adsorption holding surface 316, the shape of the cross section in the front-back direction (direction parallel to the conveyance direction of paper P) is assumed to be a wave shape and the suction hole 318 is formed on the valley part.

By forming it in this way, since paper P is pulled toward the valley part and bent, it is possible to improve the adsorption holding force more.

In this case, the suction hole 318 formed on the valley part may be a slit shape, or may be a round hole or a long hole with a constant pitch along the valley part.

Figure 14A:
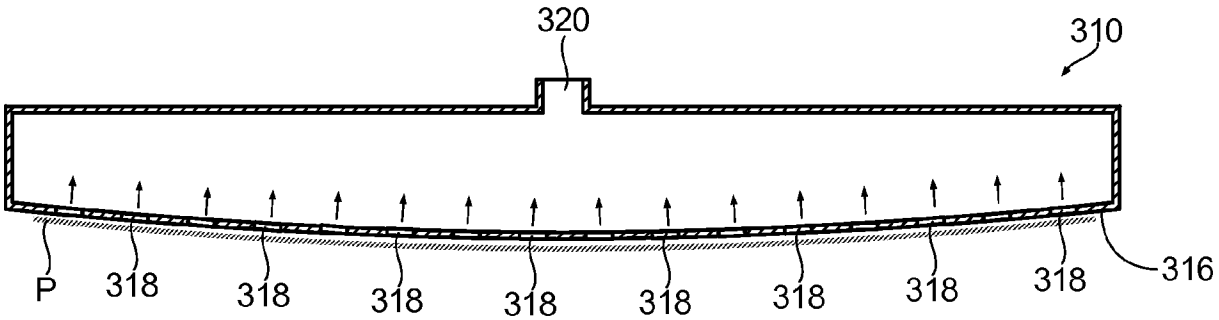
FIG. 14A is a diagram illustrating another mode of the adsorption holding surface of the suction unit.
Figure 14B:
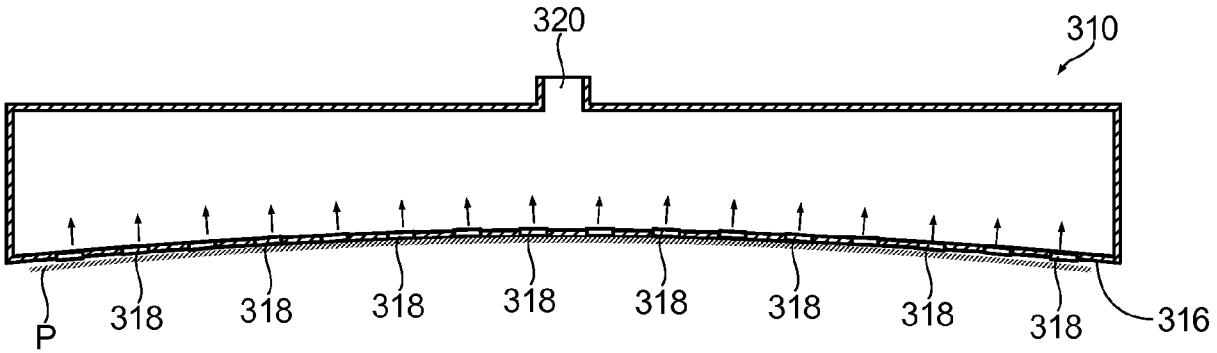
FIG. 14B is a diagram illustrating another mode of the adsorption holding surface of the suction unit.

FIGS. 14A and 14B are diagrams illustrating other modes of the adsorption holding surface of the suction unit.

In FIG. 14A, the shape of the cross section in the width direction of the adsorption holding surface 316 (direction orthogonal to the conveyance direction of paper P) is assumed to be an arc shape that becomes convex toward the image recording drum 41.

Moreover, in FIG. 14B, the shape of the cross section in the width direction of the adsorption holding surface 316 (direction orthogonal to the conveyance direction of paper P) is assumed to be an arc shape that becomes concave toward the image recording drum 41.

Thus, by assuming the shape of the cross section in the direction orthogonal to the conveyance direction of paper P to be an arc shape, since paper P follows a direction in which paper P is curved as compared with the case of the flat shape, it is possible to prevent the looseness of paper P. By this means, it is possible to prevent the occurrence of wrinkles caused at the time of pressure by the pressure roller 42 more effectively. Moreover, like FIG. 14A, by assuming it to be the arc shape that becomes convex toward the image recording drum 41, it is possible to make paper P contact the image recording drum 41 in order from the center to the both-end direction, and it is possible to prevent the occurrence of wrinkles more effectively.

Here, it is also possible to assume the shape of the cross section in the direction orthogonal to the conveyance direction of paper P to be an arc shape and assume the shape of the cross section in the direction parallel to the conveyance direction of paper P to be an arc shape or wave shape. By this means, it is possible to acquire both effects.

It is preferable that, as the shape of the adsorption holding surface 316, the optimal one is arbitrarily selected according to the kind and thickness, and so on, of used paper P.

<Other Modes of Suction Hole>

In the above-mentioned embodiment, the shape of the suction hole 318 formed on the adsorption holding surface 316 is assumed to be a slit shape, and it is formed so as to be orthogonal to the conveyance direction of paper P. The suction hole 318 of such a shape can continuously adsorb paper P in the width direction and acquire high holding force.

Various modes can be adopted for the shape of the suction hole 318, and it is preferable that the optimal one is arbitrarily selected according to the kind and thickness, and so on, of used paper P. In the following, other modes of the suction hole 318 formed on this adsorption holding surface 316 are described.

FIGS. 15A to 15G are diagrams illustrating other modes of the suction hole formed on the adsorption holding surface.

Figure 15A:
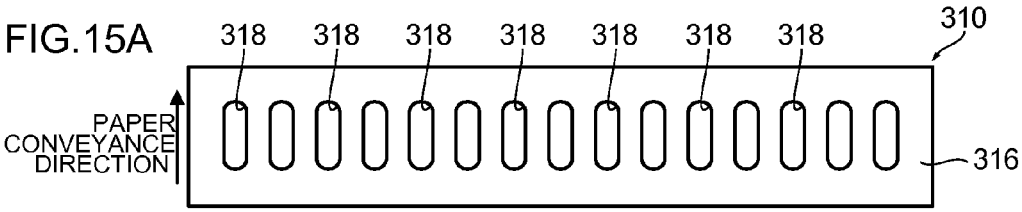
FIG. 15A is a diagram illustrating another mode of a suction hole formed on the adsorption holding surface.

In FIG. 15A, multiple suction holes 318 are formed at regular intervals along the width direction of the adsorption holding surface 316 (direction orthogonal to the conveyance direction of paper P). By this means, it is possible to suppress the deformation of paper P and smoothly guide paper P.

Here, in this case, the shape of each suction hole 318 is not especially limited. In the example illustrated in the figure, the shape of each suction hole 318 is assumed to be a long hole shape that extends in the direction parallel to the conveyance direction of the paper. By this means, it is possible to suppress the deformation of the paper and improve the holding force. Here, as illustrated in the figure, the long hole shape includes an elliptic shape and a rectangular shape (so-called hole shape in which the vertical width and the horizontal width are different) in addition to a shape whose both ends are formed in an arc shape.

Figure 15B:
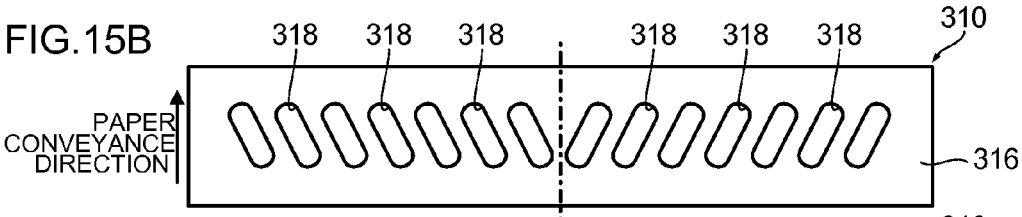
FIG. 15B is a diagram illustrating another mode of the suction hole formed on the adsorption holding surface.

In FIG. 15B, multiple suction holes 318 are formed with a constant pitch along the width direction of the adsorption holding surface 316, the shape of each suction hole 318 is assumed to be a long hole shape, and each suction hole 318 is formed to be inclined with respect to the conveyance direction of paper P and formed such that the edge part on the upstream side in the conveyance direction of paper P is located close to the center side of the adsorption holding surface 316 as compared with the edge part on the downstream side. In this case, as illustrated in the figure, each suction hole 318 is formed symmetrically with respect to the center in the width direction of the adsorption holding surface 316 and formed so as to be widened toward the end along the conveyance direction of paper P.

By forming the suction hole 318 in this way, when paper P slides on the adsorption holding surface 316, it is possible to extend wrinkles from the center of paper P to both ends in the width direction. By this means, it is possible to prevent the occurrence of wrinkles more effectively.

Figure 15C:
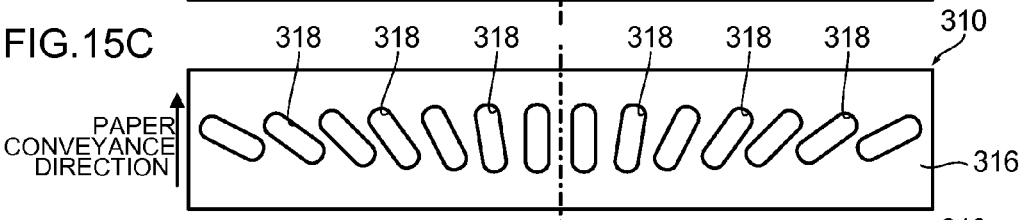
FIG. 15 C is a diagram illustrating another mode of the suction hole formed on the adsorption holding surface.
FIG. 15D is a diagram illustrating another mode of the suction hole formed on the adsorption holding surface.
FIG. 15E is a diagram illustrating another mode of the suction hole formed on the adsorption holding surface.
FIG. 15F is a diagram illustrating another mode of the suction hole formed on the adsorption holding surface.
FIG. 15G is a diagram illustrating another mode of the suction hole formed on the adsorption holding surface.

In FIG. 15C, similar to FIG. 15B, multiple suction holes 318 are formed with a constant pitch along the width direction of the adsorption holding surface 316, the shape of each suction hole 318 is assumed to be a long hole shape, and each suction hole 318 is inclined with respect to the conveyance direction of paper P and formed such that the edge part on the upstream side in the conveyance direction of paper P is located close to the center side of the adsorption holding surface 316 as compared with the edge part on the downstream side. However, in this example, the suction hole 318 formed in a position more distant from the center of the adsorption holding surface 316 has a larger tilt angle.

By forming the suction hole 318 in this way, it is possible to gradually extend wrinkles from the center of paper P to both ends in the width direction and improve the effect of extending wrinkles more.

Figure 15D:
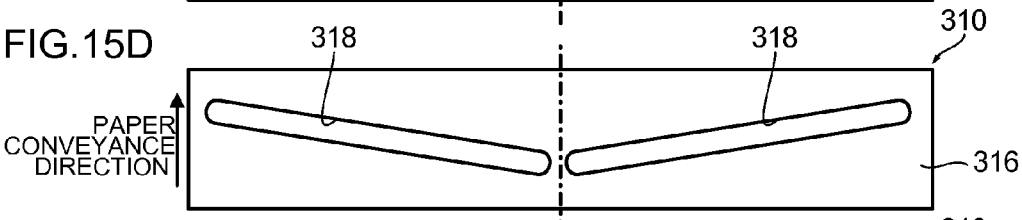

In FIG. 15D, the suction hole 318 of a slit shape is disposed symmetrically with respect to the center in the width direction the adsorption holding surface 316, and each suction hole 318 is inclined with respect to the conveyance direction of paper P and formed such that the edge part on the upstream side in the conveyance direction of paper P is located close to the center side of the adsorption holding surface 316 as compared with the edge part on the downstream side. In this case, as illustrated in the figure, the suction hole 318 is formed to be widened toward the end along the conveyance direction of paper P.

Even in a case where the suction hole 318 is formed in this way, it is possible to gradually extend wrinkles from the center of paper P to both ends in the width direction and prevent the occurrence of wrinkles more effectively.

Figure 15E:
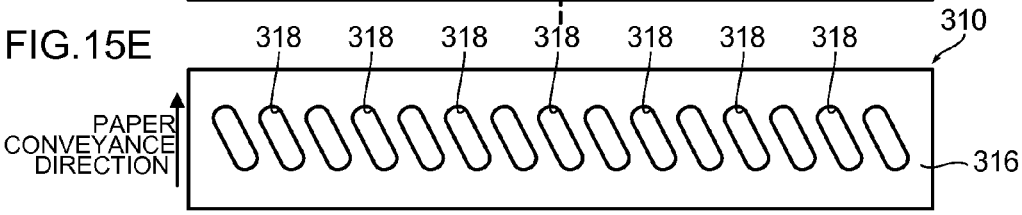

In FIG. 15E, multiple suction holes 318 are formed with a constant pitch along the width direction of the adsorption holding surface 316, the shape of each suction hole 318 is assumed to be a long hole shape, and each suction hole 318 is inclined with respect to the conveyance direction of paper P and formed.

By forming the suction hole 318 in this way, when paper P slides on the adsorption holding surface 316, it is possible to extend wrinkles from one to the other in the width direction of paper P.

Figure 15F:
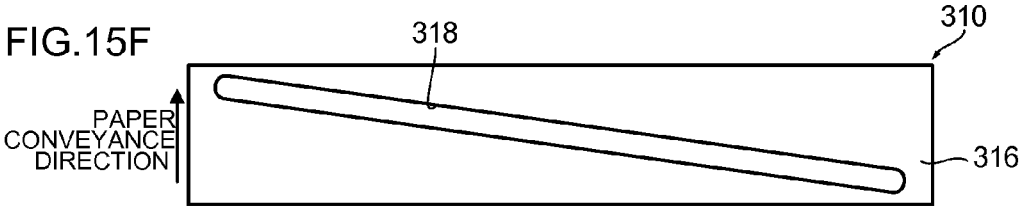

In FIG. 15F, the suction hole 318 of a slit shape is formed along the diagonal of the adsorption holding surface 316 (the suction hole 318 of a slit shape is formed to be inclined with respect to the conveyance direction of paper P).

By forming the suction hole 318 in this way, when paper P slides on the adsorption holding surface 316, it is possible to extend wrinkles from one to the other in the width direction of paper P. Moreover, it is possible to continuously adsorb paper P in the width direction and acquire high holding force.

Figure 15G:
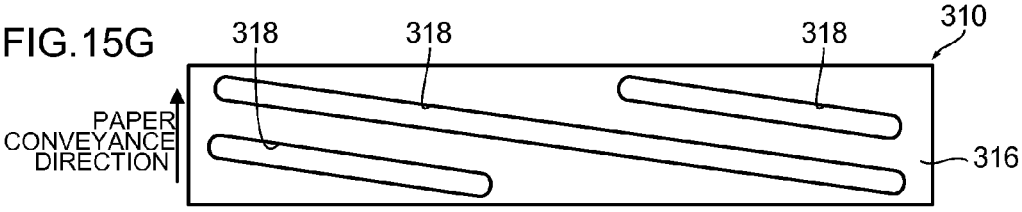

In FIG. 15G, similar to FIG. 15F, the suction hole 318 of a slit shape is formed along the diagonal of the adsorption holding surface 316 and multiple suction holes 318 parallel to this are formed.

By forming the suction hole 318 in this way, when paper P slides on the adsorption holding surface 316, it is possible to extend wrinkles from one to the other in the width direction of paper P and improve the holding force.

Figure 16A:
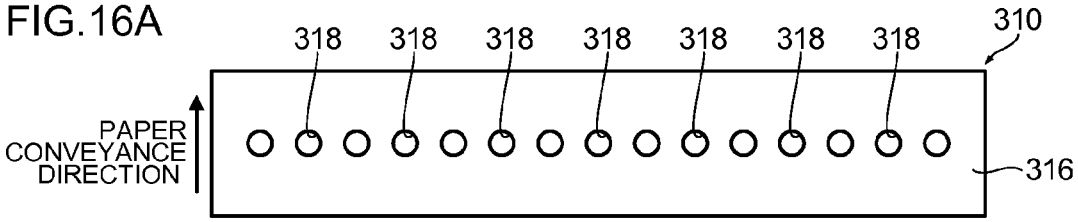
FIG. 16A is a diagram illustrating yet another mode of the suction hole formed on the adsorption holding surface.
Figure 16B:
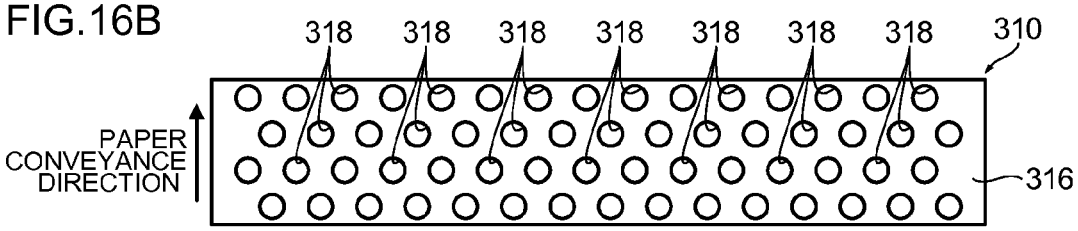
FIG. 16B is a diagram illustrating yet another mode of the suction hole formed on the adsorption holding surface.
Figure 16C:
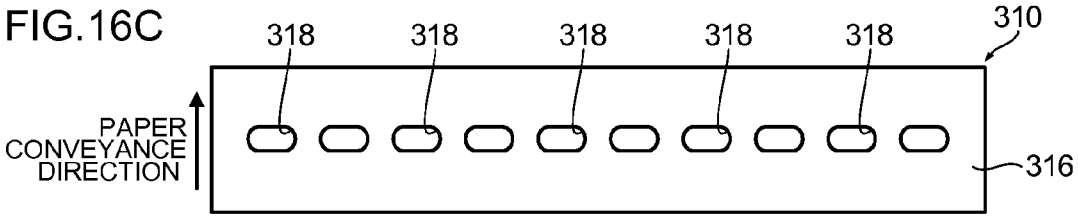
FIG. 16 C is a diagram illustrating yet another mode of the suction hole formed on the adsorption holding surface.

FIGS. 16A to 16C are diagrams illustrating other modes of the suction hole formed on the adsorption holding surface.

The shape of the suction hole 318 is assumed to be a long hole shape or a slit shape in the modes illustrated in FIGS. 15A to 15G, but the shape of the suction hole is not limited to this.

In FIG. 16A, multiple suction holes 318 of a round hole shape are formed at regular intervals along the width direction of the adsorption holding surface 316 (direction orthogonal to the conveyance direction of paper P). By assuming the suction hole 318 to be a round hole shape, it is possible to facilitate processing.

In FIG. 16B, multiple suction holes 318 of a round hole shape are formed on the adsorption holding surface 316. By this means, it is possible to increase the adsorption area and improve the holding force more.

In FIG. 16C, multiple suction holes 318 are formed at regular intervals along the width direction of the adsorption holding surface 316, and the shape of each suction hole 318 is assumed to be a long hole shape that extends along the width direction of the adsorption holding surface 316. By this means, it is possible to improve the holding force and suppress the deformation of paper P.

Figure 17A:
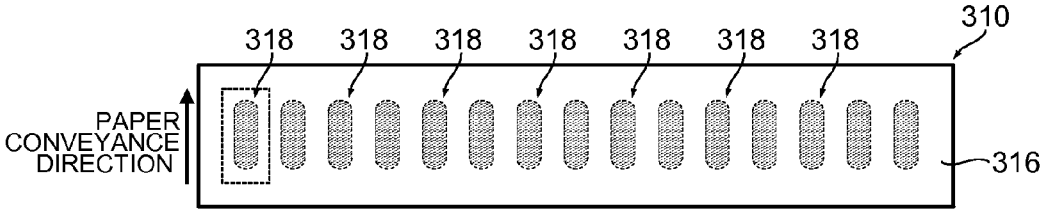
FIG. 17A is a diagram illustrating another mode of the suction hole.
Figure 17B:
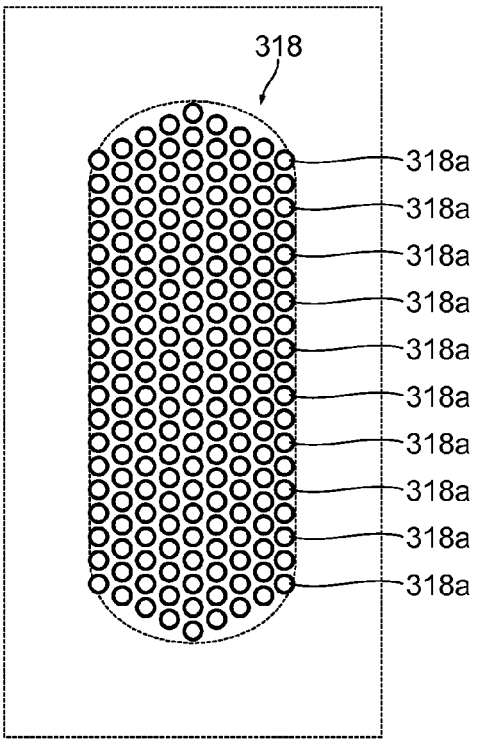
FIG. 17B is a diagram illustrating another mode of the suction hole.

Here, in a case where the suction hole 318 is assumed to be a long hole shape, as illustrated in FIGS. 17A and 17B (FIG. 17B is an enlarged view of a dotted line part in FIG. 17A), it is possible to group many round holes 318*a* of a small diameter and form a long hole shape as a whole (the external shape is assumed to be a long hole shape as a whole). By this means, it is possible to acquire high holding force and suppress the deformation of paper P. Moreover, it is possible to perform processing easily.

In the above-mentioned example, the adsorption holding surface 316 is formed to be flat for convenience of explanation, the shape of the adsorption holding surface 316 is not limited to this. Similar to a case where the suction hole 318 is formed on the adsorption holding surface 316 of other modes, it is possible to form the suction hole 318 of various modes mentioned above.

<Other Modes of Suction Unit>

The suction unit 310 can acquire stronger holding force as the contact area with paper P is larger. Therefore, it is better as the length in the paper conveyance direction of the adsorption holding surface 316 (length in the front-back direction) is longer. This length is set taking into account the installation space, and so on, and it is set to length in which the greatest effect can be acquired.

Moreover, it is preferable that length in a direction orthogonal to the conveyance direction of paper P is set to almost the same width as the paper width. Therefore, it is preferable that it is formed with almost the same width as the width of the image recording drum 41.

Figures 18A, 18B, 18C:
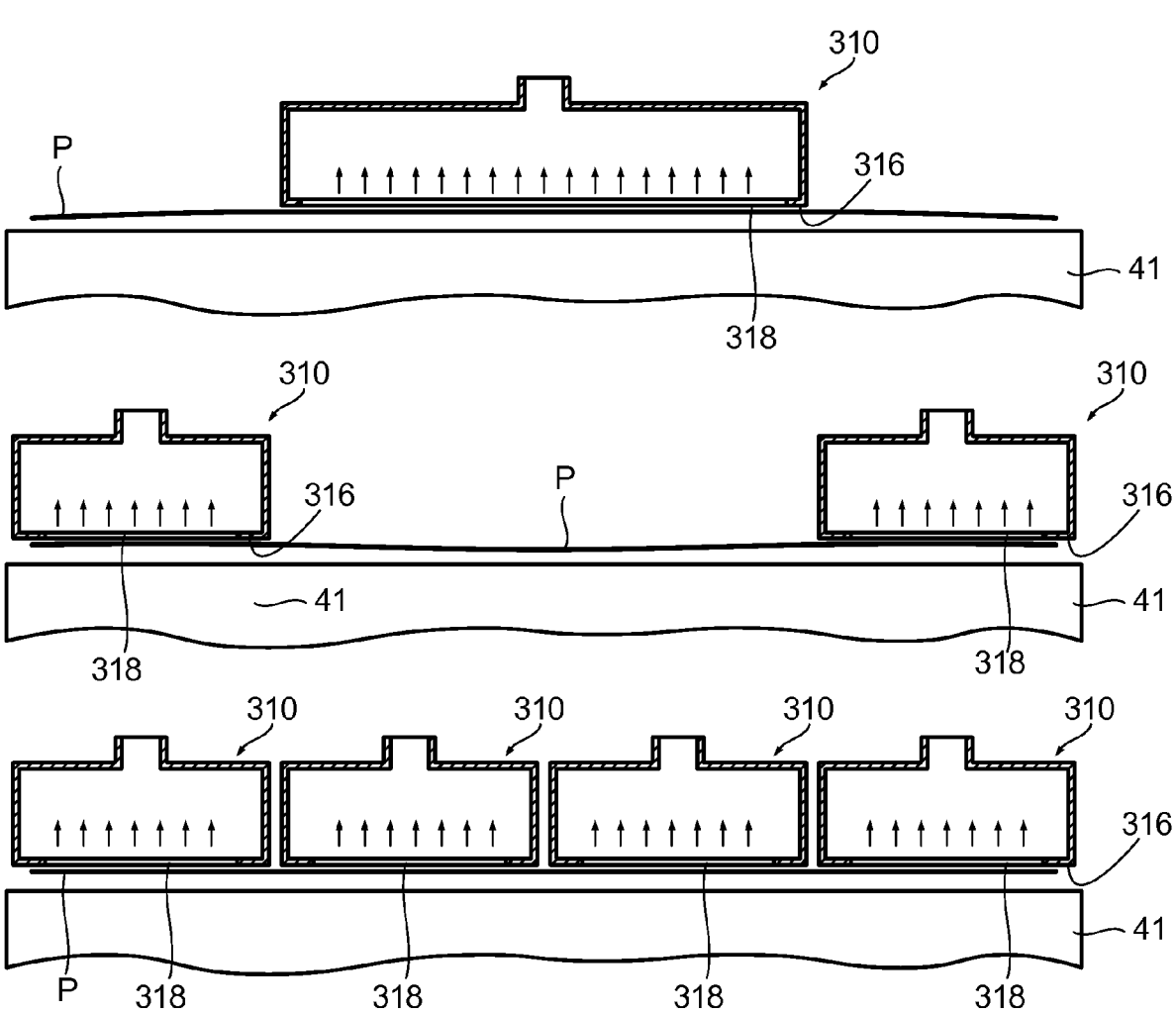
FIG. 18A is a diagram illustrating another mode of the suction unit.
FIG. 18B is a diagram illustrating another mode of the suction unit.
FIG. 18C is a diagram illustrating another mode of the suction unit.

However, as illustrated in FIG. 18A, it can be configured so as to suck only the center part of paper P, depending on the installation space and the kind of used paper P, and so on.

Moreover, as illustrated in FIG. 18B, it can be configured so as to suck both end parts in the width direction of paper P by the use of a pair of suction units 310.

In addition, as illustrated in FIG. 18C, it can be configured such that multiple suction units 310 are disposed in parallel in a direction orthogonal to the conveyance direction of paper P. In this case, it can be configured to suck each suction unit 310 by the use of one vacuum pump, but the vacuum pump can be individually installed in each suction unit 310 so as to be able to perform suction individually. By this means, it is possible to switch the suction width according to the size of paper P. Here, even in a case where one vacuum pump is used, for example, a similar effect can be acquired by installing a valve in suction piping connecting each suction unit 310 and the vacuum pump (it is configured so as to turn on/off suction individually).

Figure 19:
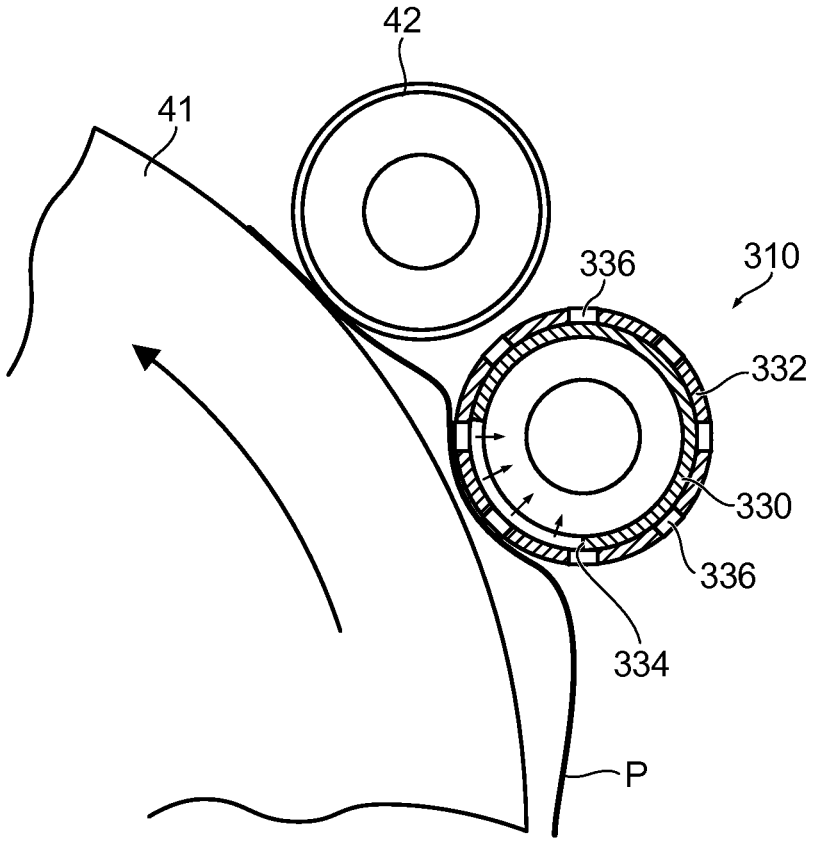
FIG. 19 is a diagram illustrating another mode of the suction unit.

Moreover, the suction unit 310 can also be formed in a roller shape as illustrated in FIG. 19.

The suction unit 310 illustrated in the figure is configured in a double tube structure formed with an inner cylinder 330 and an outer cylinder 332, and formed with almost the same width as the image recording drum 41.

The inner cylinder 330 is formed in a cylindrical shape. The inner cylinder 330 is fixed and installed while both ends are supported by an unillustrated bracket.

The outer cylinder 332 is formed in a cylindrical shape. The outer cylinder 332 is installed so as to be rotatable with respect to the outer periphery of the inner cylinder 330 through an unillustrated bearing.

An opening 334 is formed on the peripheral surface of the inner cylinder 330 in a constant angular range. Meanwhile, many suction holes 318 are formed on the outer periphery of the outer cylinder 332.

An unillustrated suction port is formed on one edge of the inner cylinder 330. The suction port is connected with the vacuum pump through the suction piping.

When the vacuum pump is driven, air in the inner cylinder 330 is sucked. By this means, the air is sucked from the suction hole 318 formed on the outer cylinder 332. Further, when the air is sucked from this suction hole 318, the front surface of paper P conveyed by the image recording drum 41 is sucked.

When paper P is sucked from the suction hole 318, it sticks to the outer peripheral surface of the outer cylinder 332. Since the outer cylinder 332 is installed so as to be rotatable, it rotates at the same time as the running of paper P (synchronous rotation).

Thus, by providing a configuration in which the suction unit 310 is formed in a roller shape and rotates in synchronization with paper P, it is possible to prevent the surface of paper P from rubbing.

Here, in this example, there is provided a configuration in which the outer cylinder 332 is supported so as to be rotatable with respect to the outer periphery of the inner cylinder 330 and rotated in synchronization with paper P, but a configuration is also possible in which it is driven by a rotation drive device such as a motor and rotated at the same speed as paper P.

Moreover, a configuration is also possible in which the outer cylinder 332 is driven by the rotation drive device such as the motor and rotated in a direction opposite to the conveyance direction of paper P. By this means, it is possible to increase the force of back tension.

<Suction Method at Back Tension Giving>

In a case where back tension is given, a configuration is possible in which air is sucked from the suction unit 310 at always constant suction force, but it is preferable that the suction force is controlled according to the conveyance of paper P. For example, it is assumed that suction is performed with strong suction force in the front edge part of paper P and the suction force is weakened afterward. If paper P can be adsorbed once, the state can be maintained, but, if the initial adsorption force is weak, there is a danger that it cannot be adsorbed. Therefore, it is assumed that suction is performed with strong suction force in the front edge part of paper P and the suction force is weakened afterward. By this means, it is possible to appropriately suck paper P. Besides this, it can be designed such that the suction force is gradually weakened toward the rear edge of paper P.

<ON/OFF of Back Tension Giving in Consideration of Paper Type>

There is provided a configuration in which back tension giving is turned on/off on the basis of paper thickness in the above-mentioned embodiment, but, by considering the paper type in addition, it is possible to prevent the occurrence of float, wrinkles and damage more appropriately. That is, the float and wrinkles can be effectively prevented by giving back tension, but a thick paper with stiffness is likely to be damaged. Meanwhile, even in the case of papers of the same thickness, the damage is remarkable in a gloss paper with high smoothness (glossiness) and is less likely to remarkable in a mat paper and a high-quality paper. Therefore, by turning on/off the back tension giving in consideration of the paper type, it is possible to prevent the occurrence of float, wrinkles and damage more appropriately. In this case, a thickness threshold is set for each paper type. The system controller 200 acquires paper thickness information and paper type information, and determines ON/OFF of back tension giving on the basis of the thickness threshold set for each paper type.

Moreover, it is configured to input paper thickness information and smoothness information from the operation unit 210 as paper information, and a configuration is also possible in which ON/OFF of back tension is controlled on the basis of the input paper thickness information and smoothness information. In this case, the system controller 200 acquires the paper thickness information and the smoothness information, and compares a preset threshold for thickness (thickness threshold) and a thickness for smoothness (smoothness threshold). Further, the back tension giving is turned on when the paper thickness is less than the thickness threshold and the smoothness is less than the smoothness threshold, and the back tension giving is turned off when the paper thickness is equal to or greater than the thickness threshold and the smoothness is equal to or greater than the smoothness threshold.

OTHER EMBODIMENTS

A case where the present invention is applied to the paper conveying mechanism of the image recording drum 41 has been described as an example in the above-mentioned embodiments, but the present invention is also applicable to other paper conveying mechanisms. For example, it is also applicable to the paper conveying mechanism of the process liquid application unit 30. In this case, a back tension giving apparatus is installed in a position previous to the application apparatus 32 (application roller). By this means, it is possible to prevent the occurrence of wrinkles in paper P pressed by the application roller.

Moreover, a configuration is also possible in which multiple suction units 310 are disposed along the conveyance direction of paper P.

Moreover, the adsorption holding mechanism is installed in the image recording drum 41 in the above-mentioned embodiments, but the present invention is also applicable to a case where the adsorption holding mechanism is not installed in the image recording drum 41.

Moreover, regarding the adsorption holding mechanism, a configuration is also possible in which adsorption is performed in other methods than a method by vacuum adsorption, for example, a method by electrostatic adsorption.

Moreover, a case where a paper as a print medium of a conveyance target, especially a sheet printing paper is conveyed has been described as an example in the above-mentioned embodiments, but the application of the present invention is not limited to this. It is similarly applicable if it is a sheet print medium formed in a sheet shape.

EXAMPLES

In the paper conveying mechanism (print medium-conveying device) of the configuration illustrated in FIG. 3, experiments have been conducted to confirm the occurrence status of float, wrinkles and damage in a case where back tension giving is turned on and a case where the back tension giving is turned off while changing the type and thickness of a paper.

A commercially available paper is used as the paper, "OK TOPCOAT+" manufactured by Oji Paper Co., Ltd. is used as a gloss paper, "OK topcoat mat N" manufactured by Oji Paper Co., Ltd. is used as a mat paper, "Shiraoi (registered trademark)" manufactured by Nippon Paper Industries Co., Ltd. is used as a high-quality paper, and "Ibest W" manufactured by Nippon Daishowa Paperboard Co., Ltd. is used as a paperboard. The occurrence status of float/wrinkles and damage when the back tension giving is turned on and when it is turned off is confirmed while changing the thickness (paper thickness) of these papers.

FIG. 20 illustrates the occurrence status of float/wrinkles and damage of the gloss paper as Example 1. FIG. 21 illustrates the occurrence status of float/wrinkles and damage of the mat paper as Example 2. FIG. 22 illustrates the occurrence status of float/wrinkles and damage of the high-quality paper as Example 3. FIG. 23 illustrates the occurrence status of float/wrinkles and damage of the paperboard as Example 4.

Example 1 confirms the occurrence status of float/wrinkles and damage of the paper when back tension (BT) giving is turned on (BT-ON) and when the back tension giving is turned off (BT-OFF) while changing the thickness of the gloss paper (paper thickness) to [1] 0.09 mm (basis weight 104.7 g/m$^2$), [2] 0.11 mm (basis weight 127.9 g/m$^2$) and [3] 0.13 mm (basis weight 157.0 g/m$^2$).

Example 2 confirms the occurrence status of float/wrinkles and damage of the paper when back tension giving is turned on (BT-ON) and when the back tension giving is turned off (BT-OFF) while changing the thickness of the mat paper (paper thickness) to [1] 0.11 mm (basis weight 104.7 g/m$^2$), [2] 0.13 mm (basis weight 127.9 g/m$^2$) and [3] 0.16 mm (basis weight 157.0 g/m$^2$).

Example 3 confirms the occurrence status of float/wrinkles and damage of the paper when back tension giving is turned on (BT-ON) and when the back tension giving is turned off (BT-OFF) while changing the thickness of the high-quality paper (paper thickness) to [1] 0.11 mm (basis weight 81.4 g/m$^2$), [2] 0.13 mm (basis weight 104.7 g/m$^2$), [3] 0.15 mm (basis weight 127.9 g/m$^2$) and [4] 0.18 mm (basis weight 157.0 g/m$^2$).

Example 4 confirms the occurrence status of float/wrinkles and damage of the paper when back tension giving is turned on (BT-ON) and when the back tension giving is turned off (BT-OFF) while changing the thickness of the paperboard (paper thickness) to [1] 0.20 mm (basis weight 210 g/m$^2$), [2] 0.26 mm (basis weight 260 g/m$^2$) and [3] 0.32 mm (basis weight 310 g/m$^2$).

<Float/Wrinkles>

As understood from the result of each example illustrated in FIGS. 20 to 23, regarding float and wrinkles, it is possible to confirm that they can be effectively prevented by giving back tension (BT-ON) in any paper type and thickness.

Moreover, when the back tension giving is turned off (BT-OFF), it is possible to confirm that float/wrinkles are likely to occur in a paper whose thickness is less than 0.13 mm, regardless of the paper type.

Meanwhile, when the thickness is equal to or greater than 0.13 mm, it is possible to confirm that the occurrence of float/wrinkles can be suppressed within tolerance even if the back tension is not given (BT-OFF). This is because the thickness of the paper becomes thick and therefore the paper has strong stiffness.

<Regarding Damage>

Regarding damage, in a case where back tension is given (BT-ON), when the paper thickness is equal to or greater than 0.13 mm, it is possible to confirm that it exceeds tolerance. Especially, regarding the gloss paper, it is possible to confirm that the damage is likely to become remarkable because of the property of the front surface and the tolerance is less likely to be satisfied. This is because, when the thickness of the paper becomes thick, the paper has strong stiffness and the front surface is rubbed against the adsorption holding surface by its own stiffness.

Meanwhile, even if the thickness of the paper is equal to or greater than 0.13 mm, it is possible to confirm that the occurrence of damage can be improved by turning off the back tension giving (BT-OFF).

Since the occurrence of damage is caused by rubbing the front surface of the paper against an adsorption holding surface, in a case where the back tension giving is turned off, it is possible to prevent the occurrence of damage more effectively by sending air from a suction hole on the adsorption holding surface (see FIG. 7) and evacuating the adsorption holding surface (see FIGS. 8 and 9).

Here, regarding damage of the paper, it does not relate to the basis weight of the paper but relates to the thickness regardless of the paper type, and it is estimated that the stiffness of the paper has an influence.

As mentioned above, in the case of a paper generally used for printing, by turning on/off back tension giving using thickness of 0.13 mm as a standard, it is possible to suppress the occurrence of float, wrinkles and damage and convey the paper. That is, by performing conveyance while giving back tension in a case where the thickness is less than 0.13 mm and by performing conveyance without giving the back tension in a case where the thickness is equal to or greater than 0.13 mm, it is possible to convey the paper without causing float, wrinkles and damage.

Moreover, it is possible to confirm that paper damage is likely to be remarkable in the gloss paper of high smoothness (glossiness) and is less likely to be remarkable in the mat paper and especially in the high-quality paper. Therefore, by turning on/off the back tension giving in consideration of not only the thickness of the paper but also information of smoothness (glossiness), it is possible to prevent the occurrence of float, wrinkles and damage more appropriately and convey the paper.

What is claimed is:

1. A print medium-conveying device comprising:

a drum that conveys a print medium by winding a sheet-like print medium around an outer peripheral surface and performing rotation;

a pressure roller that presses a front surface of the print medium wound around the outer peripheral surface of the drum and makes a back surface of the print medium contact the outer peripheral surface of the drum;

a back tension giving device having an adsorption holding surface to which the front surface of the print medium is adsorbed and held, which adsorbs and holds the front surface of the print medium to the adsorption holding surface in a position immediately before entry between the drum and the pressure roller, and gives back tension to the print medium;

a print medium information acquisition device which acquires information of the print medium; and a control device which controls ON/OFF of adsorption of the print medium by the back tension giving device, based on the information of the print medium acquired by the print medium information acquisition device, wherein:

the print medium is a paper and the information of the print medium acquired by the print medium information acquisition device is thickness of the print medium; and the control device compares the thickness of the print medium acquired by the print medium information acquisition device and a threshold set beforehand, turns on the adsorption of the print medium by the back tension giving device when the thickness of the print medium acquired by the print medium information acquisition device is less than the threshold, and turns off the adsorption of the print medium by the back tension giving device when the thickness is equal to or greater than the threshold.

2. The print medium-conveying device according to claim 1, wherein the threshold is 0.13 mm.

3. The print medium-conveying device according to claim 1, wherein the drum further includes an adsorption holding device which adsorbs and holds a back surface of the print medium wound on the outer peripheral surface.

4. An inkjet printing device comprising:

a print medium-conveying device according to claim 1; and an inkjet head that ejects an ink droplet to a front surface of the print medium conveyed by the drum.

5. The print medium-conveying device according to claim 1, wherein:

the back tension giving device performs suction from a suction hole formed on the adsorption holding surface and adsorbs and holds the front surface of the print medium to the adsorption holding surface; and the control device controls ON/OFF of the suction from the suction hole and controls ON/OFF of the adsorption of the print medium by the back tension giving device.

6. The print medium-conveying device according to claim 1, wherein:

the back tension giving device performs suction from a suction hole formed on the adsorption holding surface and adsorbs and holds the front surface of the print medium to the adsorption holding surface while preventing the print medium from contacting the adsorption holding surface by performing ventilation from the suction hole; and the control device controls the suction/ventilation from the suction hole and controls ON/OFF of the adsorption of the print medium by the back tension giving device.

7. The print medium-conveying device according to claim 1, wherein:

the back tension giving device is installed so as to be movable between a first position in which the front surface of the print medium immediately before entering between the drum and the pressure roller can be adsorbed and held to the adsorption holding surface and a second position in which the front surface of the print medium immediately before entering between the drum and the pressure roller cannot be adsorbed and held to the adsorption holding surface; and the control device controls movement of the back tension giving device and controls ON/OFF of the adsorption of the print medium by the back tension giving device.

8. The print medium-conveying device according to claim 7, wherein:

the back tension giving device performs suction from a suction hole formed on the adsorption holding surface and adsorbs and holds the front surface of the print medium to the adsorption holding surface; and the control device controls ON/OFF of the suction from the suction hole, controls movement of the back tension giving device and controls ON/OFF of the adsorption of the print medium by the back tension giving device.

9. The print medium-conveying device according to claim 7, wherein:

the back tension giving device performs suction from a suction hole formed on the adsorption holding surface and adsorbs and holds the front surface of the print medium to the adsorption holding surface while preventing the print medium from contacting the adsorption holding surface by performing ventilation from the suction hole; and the control device controls the suction/ventilation from the suction hole, controls movement of the back tension giving device and controls ON/OFF of the adsorption of the print medium by the back tension giving device.

10. A print medium-conveying device comprising:

a drum that conveys a print medium by winding a sheet-like print medium around an outer peripheral surface and performing rotation;

a pressure roller that presses a front surface of the print medium wound around the outer peripheral surface of the drum and makes a back surface of the print medium contact the outer peripheral surface of the drum;

a back tension giving device having an adsorption holding surface to which the front surface of the print medium is adsorbed and held, which adsorbs and holds the front surface of the print medium to the adsorption holding surface in a position immediately before entry between the drum and the pressure roller, and gives back tension to the print medium;

a print medium information acquisition device which acquires information of the print medium; and a control device which controls ON/OFF of adsorption of the print medium by the back tension giving device, based on the information of the print medium acquired by the print medium information acquisition device, wherein:

the print medium is a paper and the information of the print medium acquired by the print medium information acquisition device is thickness and paper type of the print medium; and the control device compares the thickness of the print medium acquired by the print medium information acquisition device and a threshold set beforehand for each paper type, turns on the adsorption of the print medium by the back tension giving device when the thickness of the print medium acquired by the print medium information acquisition device is less than the threshold, and turns off the adsorption of the print medium by the back tension giving device when the thickness is equal to or greater than the threshold.

11. The print medium-conveying device according to claim 10, wherein:

the back tension giving device performs suction from a suction hole formed on the adsorption holding surface and adsorbs and holds the front surface of the print medium to the adsorption holding surface; and the control device controls ON/OFF of the suction from the suction hole and controls ON/OFF of the adsorption of the print medium by the back tension giving device.

12. The print medium-conveying device according to claim 10, wherein:

the back tension giving device performs suction from a suction hole formed on the adsorption holding surface and adsorbs and holds the front surface of the print medium to the adsorption holding surface while preventing the print medium from contacting the adsorption holding surface by performing ventilation from the suction hole; and the control device controls the suction/ventilation from the suction hole and controls ON/OFF of the adsorption of the print medium by the back tension giving device.

13. The print medium-conveying device according to claim 10, wherein:

the back tension giving device is installed so as to be movable between a first position in which the front surface of the print medium immediately before entering between the drum and the pressure roller can be adsorbed and held to the adsorption holding surface and a second position in which the front surface of the print medium immediately before entering between the drum and the pressure roller cannot be adsorbed and held to the adsorption holding surface; and the control device controls movement of the back tension giving device and controls ON/OFF of the adsorption of the print medium by the back tension giving device.

14. The print medium-conveying device according to claim 13, wherein:

the back tension giving device performs suction from a suction hole formed on the adsorption holding surface and adsorbs and holds the front surface of the print medium to the adsorption holding surface; and the control device controls ON/OFF of the suction from the suction hole, controls movement of the back tension giving device and controls ON/OFF of the adsorption of the print medium by the back tension giving device.

15. The print medium-conveying device according to claim 13, wherein:

the back tension giving device performs suction from a suction hole formed on the adsorption holding surface and adsorbs and holds the front surface of the print medium to the adsorption holding surface while preventing the print medium from contacting the adsorption holding surface by performing ventilation from the suction hole; and the control device controls the suction/ventilation from the suction hole, controls movement of the back tension giving device and controls ON/OFF of the adsorption of the print medium by the back tension giving device.

16. The print medium-conveying device according to claim 10, wherein the drum further includes an adsorption holding device which adsorbs and holds a back surface of the print medium wound on the outer peripheral surface.

17. An inkjet printing device comprising:

a print medium-conveying device according to claim 10; and an inkjet head that ejects an ink droplet to a front surface of the print medium conveyed by the drum.

* * * * *